US010688792B2

(12) United States Patent
Nakagawa

(10) Patent No.: US 10,688,792 B2
(45) Date of Patent: Jun. 23, 2020

(54) LIQUID EJECTION HEAD, LIQUID EJECTION APPARATUS, AND LIQUID SUPPLY METHOD

(71) Applicant: CANON KABUSHIKI KAISHA, Tokyo (JP)

(72) Inventor: Yoshiyuki Nakagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/026,223

(22) Filed: Jul. 3, 2018

(65) Prior Publication Data

US 2019/0009554 A1 Jan. 10, 2019

(30) Foreign Application Priority Data

Jul. 7, 2017 (JP) ..... 2017-134030

(51) Int. Cl.
*B41J 2/175* (2006.01)
*B41J 2/18* (2006.01)

(52) U.S. Cl.
CPC ..... *B41J 2/175* (2013.01); *B41J 2/18* (2013.01); *B41J 2202/12* (2013.01)

(58) Field of Classification Search
USPC ..... 347/85, 86
See application file for complete search history.

(56) References Cited

U.S. PATENT DOCUMENTS 4,929,963 A 5/1990 Balazar
5,583,549 A 12/1996 Ujita et al.
8,794,746 B2 8/2014 Kashu et al.
8,851,639 B2 10/2014 Arimoto
9,090,084 B2 7/2015 Govyadinov et al.
9,616,673 B2 4/2017 Domae
9,649,849 B2 5/2017 Ohtsu et al.
9,694,594 B2 7/2017 Ando
9,931,845 B2 4/2018 Moriya et al.
(Continued)

FOREIGN PATENT DOCUMENTS

CN 1103031 A 5/1995
CN 103003577 A 3/2013
(Continued)

OTHER PUBLICATIONS

Extended European Search Report dated Nov. 27, 2018, in European Patent Application No. 18181845.1.
(Continued)

*Primary Examiner* — Lam S Nguyen
(74) *Attorney, Agent, or Firm* — Venable LLP

(57) ABSTRACT

A liquid ejection head includes a recording element substrate including an ejection orifice for ejecting liquid, a pressure chamber provided with an energy generating element for generating energy used to eject liquid, a liquid supply path for supplying liquid to the pressure chamber, and a liquid collecting path for collecting liquid from the pressure chamber. The liquid supply path, the pressure chamber, and the liquid collecting path of the recording element substrate constitute a part of a circulation path in which liquid flows in the order mentioned. The flow resistance $R_{In}$ of a flow path including the liquid supply path at a supply side is greater than the flow resistance $R_{Out}$ of a flow path including the liquid collecting path at a collection side.

16 Claims, 21 Drawing Sheets

(56) References Cited

U.S. PATENT DOCUMENTS

| | | | |
|---|---|---|---|
| 9,987,854 | B2 | 6/2018 | Kobayashi |
| 10,086,609 | B2 | 10/2018 | Hozumi et al. |
| 2010/0327025 | A1 | 12/2010 | Yokoyama et al. |
| 2011/0050794 | A1 | 3/2011 | Koike et al. |
| 2011/0228012 | A1 | 9/2011 | Yoshida et al. |
| 2012/0098899 | A1 | 4/2012 | Xie et al. |
| 2013/0208059 | A1 | 8/2013 | Arimoto |
| 2013/0300811 | A1 | 11/2013 | Kashu et al. |
| 2017/0197419 | A1 | 7/2017 | Okushima et al. |
| 2018/0162130 | A1 | 6/2018 | Moriya et al. |

FOREIGN PATENT DOCUMENTS

| | | | |
|---|---|---|---|
| CN | 103241003 | A | 8/2013 |
| CN | 103786439 | A | 5/2014 |
| CN | 106004071 | A | 10/2016 |
| CN | 106256551 | A | 12/2016 |
| CN | 106794695 | A | 5/2017 |
| CN | 106794696 | A | 5/2017 |
| EP | 2 628 599 | A1 | 8/2013 |
| JP | 2806987 | B2 | 9/1998 |
| JP | 2002-355973 | A | 12/2002 |
| JP | 2016-107495 | A | 6/2016 |
| WO | 2011/138729 | A2 | 11/2011 |
| WO | 2011-146069 | A1 | 11/2011 |
| WO | 2012-058035 | A1 | 5/2012 |

OTHER PUBLICATIONS

U.S. Appl. No. 15/976,470, Kazuhiro Yamada, Toru Nakagawa, Yoshiyuki Nakagawa, Shingo Okushima, filed May 10, 2018.

U.s. Appl. No. 15/991,256, Shingo Okushima, Seiichiro Karita, Takatsuna Aoki, Noriyasu Nagai, Eisuke Nishitani, Yoshiyuki Nakagawa, filed May 29, 2018.

U.S. Appl. No. 15/992,667, Takuro Yamazaki, Toru Nakakubo, Kazuhiro Yamada, Yoshiyuki Nakagawa, Yoshihiro Hamada, Koichi Ishida, Shingo Okushima, filed May 30, 2018.

U.S. Appl. No. 15/995,493, Toru Nakakubo, Takuro Yamazaki, Kazuhiro Yamada, Yoshiyuki Nakagawa, filed Jun. 1, 2018.

U.S. Appl. No. 16/000,238, Yoshiyuki Nakagawa, Takuro Yamazaki, Kazuhiro Yamada, Toru Nakakubo, filed Jun. 5, 2018.

U.S. Appl. No. 16/006,312, Takuro Yamazaki, Tom Nakakubo, Kazuhiro Yamada, Yoshiyuki Nakagawa, Akiko Hammura, filed Jun. 12, 2018.

Office Action dated Feb. 14, 2020, in European Patent Application No. 18 181 845.1.

Office Action dated Apr. 1, 2020, in Chinese Patent Application No. 201810733947.1.

LIQUID EJECTION HEAD, LIQUID EJECTION APPARATUS, AND LIQUID SUPPLY METHOD

BACKGROUND OF THE INVENTION

Field of the Invention

The present disclosure relates to a liquid ejection head, a liquid ejection apparatus, and a liquid supply method.

Description of the Related Art

In a liquid ejection head of a liquid ejection apparatus that ejects a liquid such as ink, volatile components in the liquid are evaporated from an ejection orifice that ejects the liquid, and thus the liquid in the vicinity of the ejection orifice increases in viscosity. Due to such an increase in viscosity, there arises a problem that the ejection speed of ejected droplets is changed or the landing precision thereof is affected. Particularly, when downtime after liquid ejection is long, an increase in viscosity of liquid becomes remarkable, solid components in the liquid adhere to the vicinity of the ejection orifice, and a flow resistance increases due to the adhering solid components, which may result in ejection failure.

As a countermeasure for such an increase in viscosity of a liquid, a method of forming a circulation path passing through a liquid ejection head to circulate a liquid is known. Japanese Patent Application Laid-Open No. 2002-355973 discloses a liquid ejection head configured to circulate a liquid ink using a flow path formed between a member provided with an ejection orifice and a substrate provided with an energy generating element (for example, a heating resistor) for liquid ejection. According to such a liquid ejection head, since the liquid flows even during non-ejection, the evaporation of volatile components in the liquid from the ejection orifice is suppressed, which contributes to the prevention of clogging of the ejection orifice.

Further, when the viscosity of the liquid increases even if the liquid is circulated, there is a method of ejecting the liquid at low viscosity by heating the vicinity of the ejection orifice with a heater or the like.

In the configuration described in Japanese Patent Application Laid-Open No. 2002-355973, when a liquid is not ejected, a circulation flow, which flows from the supply side of a pressure chamber into the pressure chamber and flows out from the collection side of the pressure chamber, is formed by a difference in pressure between the supply side (IN side) and collection side (OUT side) of the pressure chamber provided with an energy generating element and communicating with an ejection orifice. In contrast, when a liquid is ejected, the liquid flows into the pressure chamber from both the supply side and the collection side, and is guided to the ejection orifice. At this time, in order to form the circulation flow, the pressure at the supply side is higher than the pressure at the collection side. The amount of a liquid from the supply side where a liquid flow toward the pressure chamber originally occurs is large, and the amount of a liquid from the collection side opposite to a liquid flow originating from the pressure chamber is small. Generally, the ejection amount of a liquid is larger than the circulation amount thereof, and in many cases, the temperature of a liquid at the supply side before flowing into the pressure chamber provided with an energy generating element is lower than the temperature of a liquid at the collection side after passing through the pressure chamber provided with the energy generating element. Therefore, the amount of the low-temperature liquid supplied from the supply side is very large, and it is required to rapidly increase the temperature of the liquid by rapidly heating the inside of the pressure chamber when lowering the viscosity of the liquid by heating the vicinity of the ejection orifice with a heater or the like, so that a large amount of electric power is required.

SUMMARY OF THE INVENTION

The present disclosure, in view of the above problems, intends to provide a liquid ejection head, a liquid ejection apparatus, and a liquid supply method, which can reduce electric power necessary for temperature adjustment of a liquid circulating through the liquid ejection head and ejecting to the outside.

A liquid ejection head according to the present disclosure includes: a recording element substrate including an ejection orifice for ejecting liquid, a pressure chamber provided with an energy generating element for generating energy used to eject liquid, a liquid supply path for supplying liquid to the pressure chamber, and a liquid collecting path for collecting liquid from the pressure chamber, wherein the liquid supply path, the pressure chamber, and the liquid collecting path of the recording element substrate constitute a part of a circulation path in which liquid flows in the order mentioned, and a flow resistance $R_{In}$ of a flow path including the liquid supply path at a supply side is greater than a flow resistance $R_{Out}$ of a flow path including the liquid collecting path at a collection side.

Further features of the present invention will become apparent from the following description of exemplary embodiments with reference to the attached drawings.

DESCRIPTION OF THE EMBODIMENTS

Hereinafter, application examples and embodiments to which the present disclosure can be applied will be described with reference to the accompanying drawings. First, application examples to which the present disclosure can be applied will be described, and then embodiments of the present disclosure will be described. However, the following description does not limit the scope of the present disclosure. In the present application example, as an example, a thermal method, in which a liquid is ejected by generating bubbles by a heating element, is employed, but the present disclosure can also be applied to a liquid ejection head employing a piezo method and various other liquid ejection methods.

The present application example is an inkjet recording apparatus (recording apparatus) in the form of circulating a liquid such as ink between a tank and a liquid ejection head, but other forms may be used. For example, the present application example may be configuration where two tanks are provided at the upstream side and downstream side of a liquid ejection head without circulating ink, and ink flows from one tank to the other tank, thereby causing the ink in a pressure chamber to flow.

Further, the present application example is a so-called line type (page-wide type) head having a length corresponding to the width of a recording medium, but the present disclosure can also be applied to a so-called serial type liquid ejection head that performs recording while scanning a recording medium. As the serial type liquid ejection head, for example, there is a configuration in which one recording element substrate for black ink and one recording element substrate for color ink are respectively mounted. However, the present application example is not limited thereto, and may be a configuration where a shorter line head, which is shorter than the width of a recording medium and in which several recording element substrates are arranged in the row direction of an ejection orifice so as to overlap the ejection orifice, is made, and the shorter line head scans the recording medium.

Application Examples (Description of Ink Jet Recording Apparatus)

Figure 1:
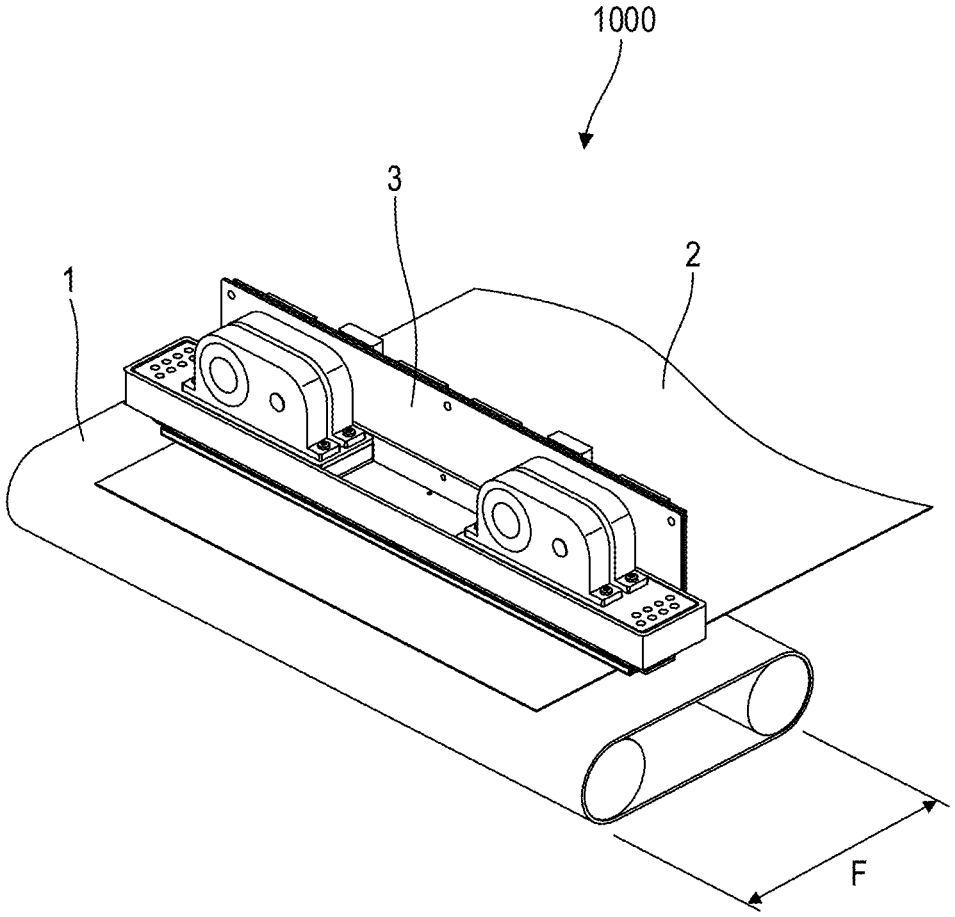
FIG. 1 is a perspective view showing a schematic configuration of a liquid ejection apparatus according to a first application example of the present disclosure.

FIG. 1 shows a schematic configuration of a liquid ejection apparatus, particularly, an ink jet recording apparatus 1000 (hereinafter also referred to as a recording apparatus) that performs recording by ejecting ink, according to the present disclosure. The recording apparatus 1000 is a line type recording apparatus that includes a conveyance unit 1 for conveying a recording medium 2 and a line type liquid ejection head 3 disposed substantially orthogonal to the conveying direction of the recording medium 2 and performs continuous recording in one pass while continuously or intermittently conveying the plurality of recording media 2. The recording medium 2 is not limited to cut paper, and may be continuous roll paper. The liquid ejection head 3 is configured such that a liquid supply unit, which can perform full color printing with CMYK (cyan, magenta, yellow, and black) ink and is a supply path for supplying a liquid to a liquid ejection head (as will be described later), a main tank, and a buffer tank (refer to FIG. 2) are fluidically connected to one another. Further, an electric control unit for transmitting electric power and an ejection control signal to the liquid ejection head 3 is electrically connected to the liquid ejection head 3. The liquid path and electrical signal path in the liquid ejection head 3 will be described later.

(Description of First Circulation Path)

Figure 2:
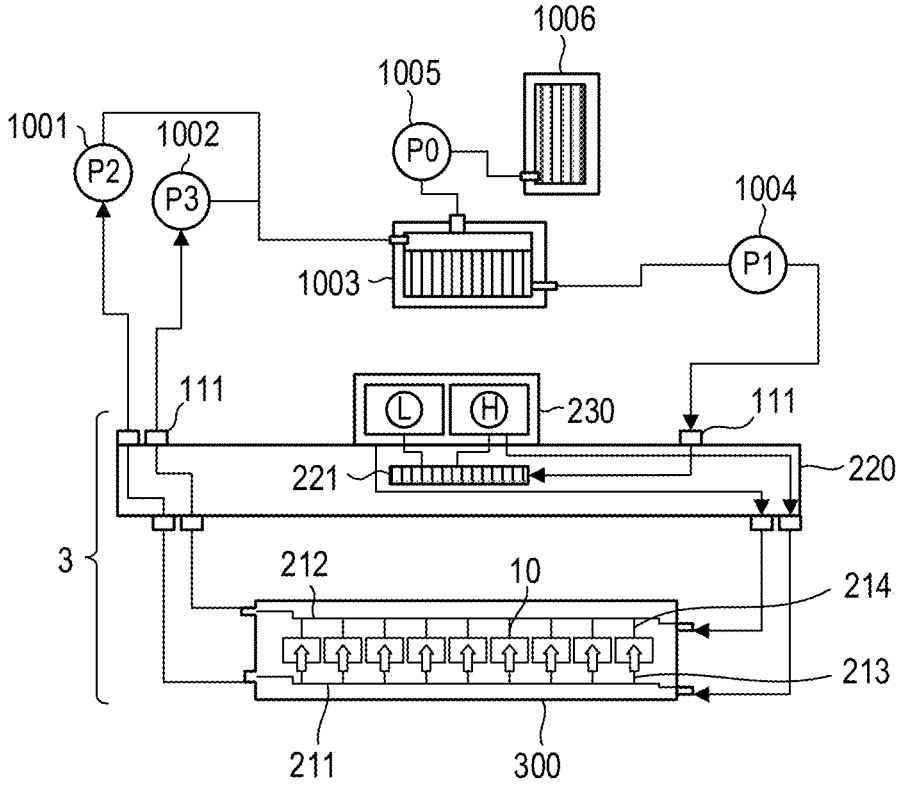
FIG. 2 is a view showing a first circulation path of the liquid ejection apparatus shown in FIG. 1.

FIG. 2 is a schematic view showing a first circulation path which is one form of the circulation paths applied to the recording apparatus of the present application example. FIG. 2 shows a state in which the liquid ejection head 3 is fluidically connected to a first circulation pump (high pressure side) 1001 which is a flowing unit, a first circulation pump (low pressure side) 1002, a buffer tank 1003, and the like. In FIG. 2, for the sake of simple explanation, only a path through which ink of one color among the CMYK colors flows is shown, but actually, circulation paths for four colors are provided to the liquid ejection head 3 and the main body of the recording apparatus 1000. The buffer tank 1003, which is a sub tank connected to a main tank 1006, has an atmosphere communication port (not shown) that communicates with the inside and outside of the tank, and can discharge bubbles in the ink to the outside. The buffer tank 1003 is also connected to a replenishment pump 1005. When liquid is consumed by the liquid ejection head 3 by ejecting (discharging) ink from the ejection orifice of the liquid ejection head 3, such as recording by ink ejection and collection by suction, the replenishment pump 1005 transfers the consumed ink from the main tank 1006 to the buffer tank 1003.

The two first circulation pumps 1001 and 1002 have a function of sucking a liquid from a liquid connection portion 111 of the liquid ejection head 3 and flowing the liquid to the buffer tank 1003. As the first circulation pump, which is a flowing unit for flowing the liquid in the liquid ejection head 3, a positive displacement pump having quantitative liquid transfer capability is preferable. Specifically, a tube pump, a gear pump, a diaphragm pump, and a syringe pump are exemplified, but, for example, a constant flow valve or a relief valve may be disposed at a pump outlet so as to secure a constant flow rate. When the liquid ejection head 3 is driven, a certain amount of ink flows through the common supply flow path 211 and the common collection flow path 212 by the first circulation pump (high pressure side) 1001 and the first circulation pump (low pressure side) 1002, respectively. As this flow rate, it is preferable to set the flow rate to such a degree that the temperature difference between recording element substrates 10 in the liquid ejection head 3 does not affect recorded image quality. However, if too much flow rate is set, due to the influence of a pressure loss of the flow path in a liquid ejection unit 300, the negative pressure difference in the respective recording element substrates 10 becomes too large, thereby causing density unevenness of an image. Therefore, it is preferable to set the flow rate while considering the temperature difference and negative pressure difference between the respective recording element substrates 10.

A negative pressure control unit 230 is provided in the path between a second circulation pump 1004 and a liquid ejection unit 300. This negative pressure control unit 230 has a function of maintaining the pressure at the downstream side of the negative pressure control unit 230 (that is, at the side of the liquid ejection unit 300) at preset constant pressure even when the flow rate of a circulation system is changed by the difference in duty (Duty) at which recording is performed. As two pressure adjustment mechanisms constituting the negative pressure control unit 230, any mechanism may be used as long as the downstream pressure thereof can be controlled to a variation not more than a certain range around a desired set pressure as a center. As an example, a mechanism similar to the so-called "depressurization regulator" can be employed. When the depressurization regulator is used, as shown in FIG. 2, it is preferable that the second circulation pump 1004 pressurizes the upstream side of the negative pressure control unit 230 through a liquid supply unit 220. In this way, the influence of hydraulic head pressure (water load) on the liquid ejection head 3 of the buffer tank 1003 can be suppressed, so that the freedom degree of layout of the buffer tank 1003 in the recording apparatus 1000 can be expanded. As the second circulation pump 1004, it is sufficient as long as it has a lift pressure equal to or higher than a constant pressure within the range of the ink circulation flow rate used when the liquid ejection head 3 is driven, and a turbo type pump, a positive-displacement pump or the like can be used. Specifically, a diaphragm pump or the like can be employed. Further, in place of the second circulation pump 1004, for example, a hydraulic head tank disposed to have a certain hydraulic head difference with respect to the negative pressure control unit 230 can be employed.

As shown in FIG. 2, the negative pressure control unit 230 is provided with two pressure adjustment mechanisms in which control pressures different from each other are set. In the two negative pressure adjustment mechanisms, the relative high pressure setting side (described as H in FIG. 2) and the relative low pressure setting side (described as L in FIG. 2) pass through the liquid supply unit 220 to be connected to a common supply flow path 211 and a common collection flow path 212 in the liquid ejection unit 300. The liquid ejection unit 300 is provided with a common supply flow path 211, a common collection flow path 212, an individual supply flow path 213, and an individual collection flow path 214 that communicate with each recording element substrate. Since the individual flow paths 213 and 214 communicate with the common supply flow path 211 and the common collection flow path 212, a part of the liquid passes through the internal flow path of the recording element substrate 10 to generate a flow (arrow in FIG. 2) from the common supply flow path 211 to the common collection flow path 212. Since the pressure adjustment mechanism H is connected to the common supply flow path 211 and the pressure adjustment mechanism L is connected to the common collection flow path 212, differential pressure is generated between the two common flow paths.

In this way, in the liquid ejection unit 300, a flow occurs, in which a part of a liquid passes through each recording element substrate 10 while passing through the common supply flow path 211 and the common collection flow path 212, respectively. Therefore, it is possible to discharge the heat generated in each recording element substrate 10 to the outside of the recording element substrate 10 by the flow of the common supply flow path 211 and the common collection flow path 212. Further, according to such a configuration, when recording is performed by the liquid ejection head 3, it is possible to cause an ink flow in the ejection orifice and the pressure chamber, so that it is possible to suppress an increase in viscosity of the ink at the site. Further, it is possible to discharge the thickened ink and foreign matter in the ink to the common collection flow path 212. Therefore, the liquid ejection head 3 of the present application example can perform high-speed and high-quality recording.

(Description of Second Circulation Path)

Figure 3:
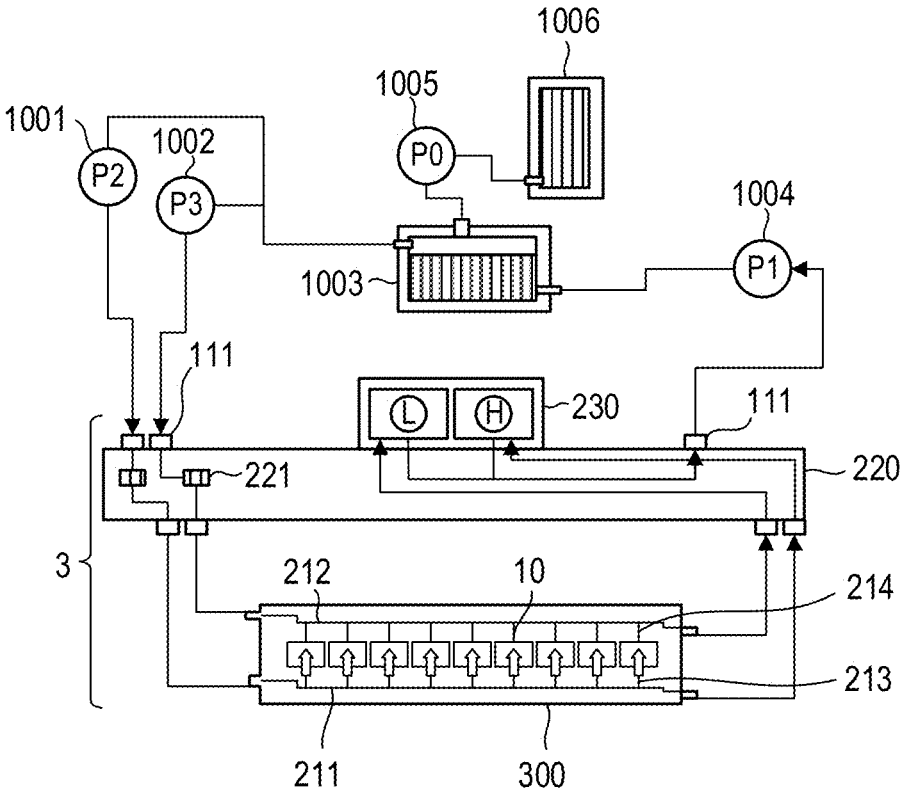
FIG. 3 is a view showing a second circulation path of the liquid ejection apparatus shown in FIG. 1.

FIG. 3 is a schematic view showing a second circulation path which is a circulation form different from the above-described first circulation path among the circulation paths applied to the recording apparatus of the present application example. The main differences from the first circulation path are as follows. The two pressure adjustment mechanisms constituting the negative pressure control unit 230 are mechanisms (mechanism components of the same action as so-called "back pressure regulator") that control the pressure upstream of the negative pressure control unit 230 to a variation within a certain range around a desired set pressure as a center. Further, the second circulation pump 1004 acts as a negative pressure source that depressurizes the downstream side of the negative pressure control unit 230. The first circulation pump (high pressure side) 1001 and the first circulation pump (low pressure side) 1002 are disposed at the upstream side of the liquid ejection head, and the negative pressure control unit 230 is disposed at the downstream side of the liquid ejection head.

The negative pressure control unit 230 of this application example stabilizes the pressure variation at the upstream side (the liquid ejection unit 300 side) within a certain range around a preset pressure as a center even if there is a variation in the flow rate caused by the change in the recording duty at the time of recording by the liquid ejection head 3. As shown in FIG. 3, it is preferable that the downstream side of the negative pressure control unit 230 is pressurized by the second circulation pump 1004 through the liquid supply unit 220. In this way, the influence of the hydraulic head pressure of the buffer tank 1003 on the liquid ejection head 3 can be suppressed, so that the selection range of layout of the buffer tank 1003 in the recording apparatus 1000 can be widened. Further, in place of the second circulation pump 1004, for example, a hydraulic head tank disposed to have a certain hydraulic head difference with respect to the negative pressure control unit 230 can be employed.

Similarly to the first application example, as shown in FIG. 3, the negative pressure control unit 230 is provided with two pressure adjustment mechanisms in which control pressures different from each other are set. In the two negative pressure adjustment mechanisms, the high pressure setting side (described as H in FIG. 3) and the low pressure setting side (described as L in FIG. 3) pass through the liquid supply unit 220 to be connected to a common supply flow path 211 and a common collection flow path 212 in the liquid ejection unit 300. The pressure of the common supply flow path 211 is made relatively higher than the pressure of the common collection flow path 212 by the two negative pressure adjustment mechanisms, thereby generating an ink flow (arrow in FIG. 3) from the common supply flow path 211 to the common collection flow path 212 through the individual flow path 213 and a flow path in each recording element substrate 10. In this way, in the second circulation path, the same ink flow state as the first circulation path can be obtained in the liquid ejection unit 300, but there are two advantages different from those of the case of the first circulation path.

The first advantage is that, in the second circulation path, the negative pressure control unit 230 is disposed at the downstream side of the liquid ejection head 3, so that a concern that dust and foreign matter generated from the negative pressure control unit 230 will flow into the head decreases. The second advantage is that, in the second circulation path, the maximum value of the necessary flow rate to be supplied from the buffer tank 1003 to the liquid ejection head 3 is smaller than that in the case of the first circulation path. The reason for this is as follows. When ink circulates during a recording standby state, the sum of the flow rates inside the common supply flow path 211 and the common collection flow path 212 is set to A. The value of A is defined as the minimum flow rate necessary for making the temperature difference in the liquid ejection unit 300 within a desired range when temperature adjustment of the liquid ejection head 3 is performed during recording standby. Further, the ejection flow rate in the case where ink is ejected from all the ejection orifices of the liquid ejection unit 300 (during all ejection) is defined as F. Then, in the case of the first circulation path (FIG. 2), since the set flow rate of the first circulation pump (high pressure side) 1001 and the first circulation pump (low pressure side) 1002 is A, the maximum value of the amount of liquid supplied to the liquid ejection head 3 required at the time of all ejection is A+F.

On the other hand, in the case of the second circulation path (FIG. 3), the amount of liquid supplied to the liquid ejection head 3 necessary for recording standby is flow rate A. Further, the amount of liquid supplied to the liquid ejection head 3 required at the time of all ejection is flow rate F. Then, in the case of the second circulation path, the total value of the set flow rates of the first circulation pump (high pressure side) 1001 and the first circulation pump (low pressure side) 1002, that is, the maximum value of the necessary supply flow rate, is the larger value of A or F. Therefore, as long as the liquid ejection unit 300 having the same configuration is used, the maximum value (A or F) of the necessary supply flow rate in the second circulation path is necessarily smaller than the maximum value (A+F) of the necessary supply flow rate in the first circulation path. Thus, in the case of the second circulation path, the degree of freedom of an employable circulation pump is high, so that, for example, a low-cost circulation pump having a simple configuration can be used, or the load of a cooler (not shown) installed in the main body side path can be reduced. As a result, there is an advantage that the cost of the main body of a recording apparatus can be reduced. This advantage increases with respect to line heads each having a relatively large A or F value, and, among the line heads, a line head having a longer length in the longitudinal direction is more advantageous.

However, there are also points that the first circulation path is advantageous compared to the second circulation path. That is, in the second circulation path, since the flow rate of liquid flowing through the liquid ejection unit 300 at the time of recording standby is the maximum, as the recording duty of an image becomes lower, a higher negative pressure is applied to the vicinity of each ejection orifice. Particularly, when a head width (length in the lateral direction of the liquid ejection head) is reduced by reducing a flow path width (length in the direction orthogonal to flow direction of liquid) of the common supply flow path 211 and the common collection flow path 212, a high negative pressure is applied to the vicinity of the ejection orifice in a low duty image which is easy to see unevenness. Therefore, the influence of satellite droplets may increase. On the other hand, in the case of the first circulation path, since high negative pressure is applied to the vicinity of the ejection orifice at the time of forming a high-duty image, there are advantages that even if satellite droplets are generated, it is difficult to visually recognize these satellite droplets, and the influence of the satellite droplets on an image is small. For the selection of the two circulation paths, preferred one can be employed in light of specifications of the liquid ejection head and the recording apparatus main body (ejection flow rate F, minimum circulation flow rate A, flow path resistance in head, and the like).

(Description of Configuration of Liquid Ejection Head)

Figure 4A:
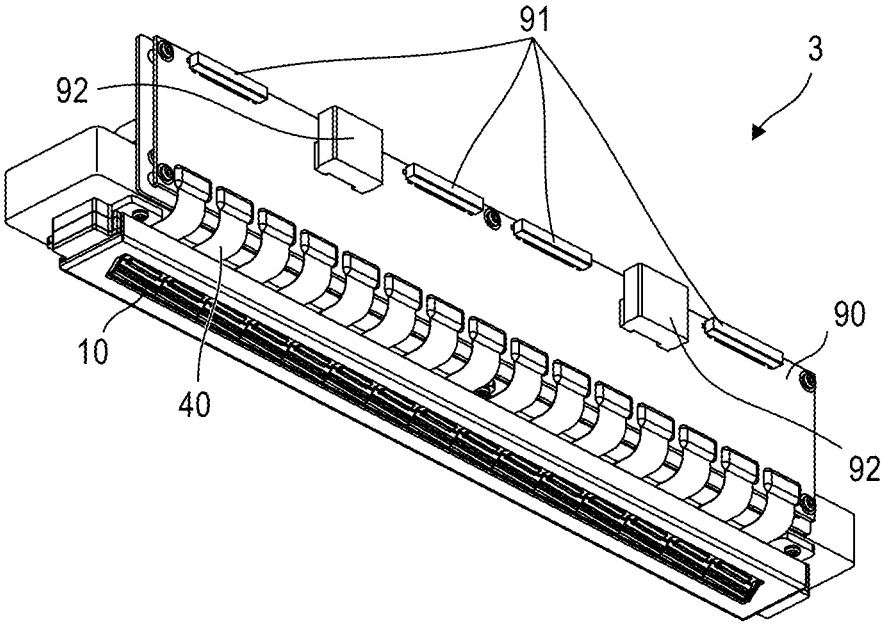
FIGS. 4A and 4B are perspective views showing a liquid ejection head according to a first application example of the present disclosure.
Figure 4B:
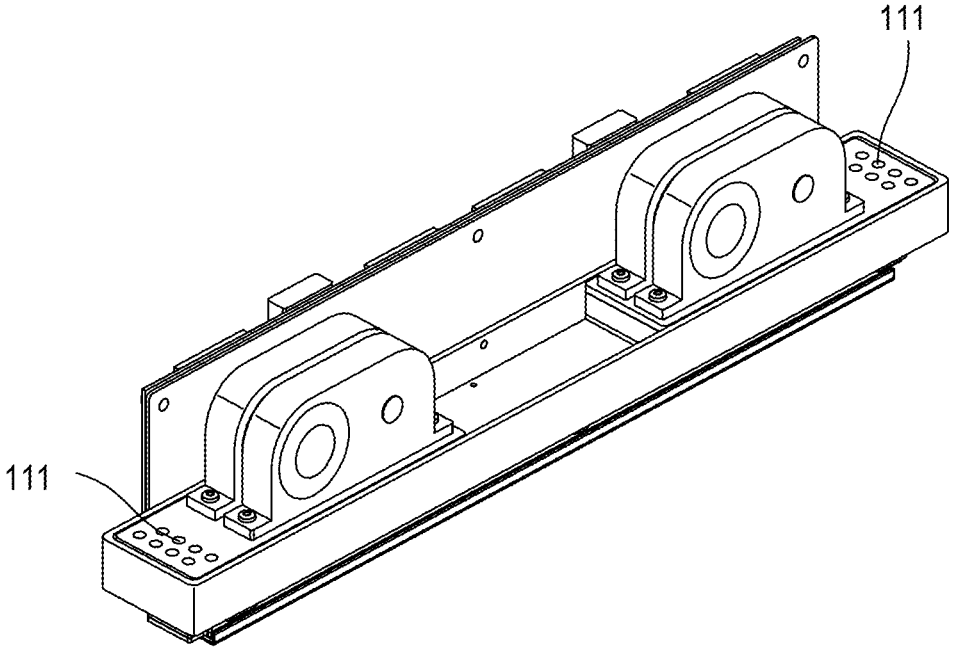

The configuration of the liquid ejection head 3 according to a first application example will be described. FIGS. 4A and 4B are perspective views of the liquid ejection head 3 according to the present application example. The liquid ejection head 3 is a line type (page-wide type) liquid ejection head in which fifteen recording element substrates 10 capable of ejecting ink of four colors of C/M/Y/K are linearly arranged. As shown in FIG. 4A, the liquid ejection head 3 includes signal input terminals 91 and power supply terminals 92 that are electrically connected to the respective recording element substrates 10 via a flexible wiring substrate 40 and an electric wiring board 90. The signal input terminals 91 and the power supply terminals 92 are electrically connected to a control unit of the recording apparatus 1000 and supply an ejection driving signal and a power necessary for ejection to the recording element substrates 10, respectively. The number of the signal input terminals 91 and the power supply terminals 92 can be made smaller than the number of the recording element substrates 10 by concentrating the wirings by the electric circuit in the electric wiring board 90. Thus, it is possible to reduce the number of electrical connection portions that need to be removed when assembling the liquid ejection head 3 to the recording apparatus 1000 or replacing the liquid ejection head. As shown in FIG. 4B, the liquid connection portions 111 provided at both ends of the liquid ejection head 3 are connected to a liquid supply system of the recording apparatus 1000. Thus, inks of four colors of CMYK are supplied from the liquid supply system of the recording apparatus 1000 to the liquid ejection head 3, and the inks that have passed through the liquid ejection head 3 are collected into the liquid supply system of the recording apparatus 1000. In this way, the ink of each color can circulate through the path of the recording apparatus 1000 and the path of the liquid ejection head 3.

Figure 5:
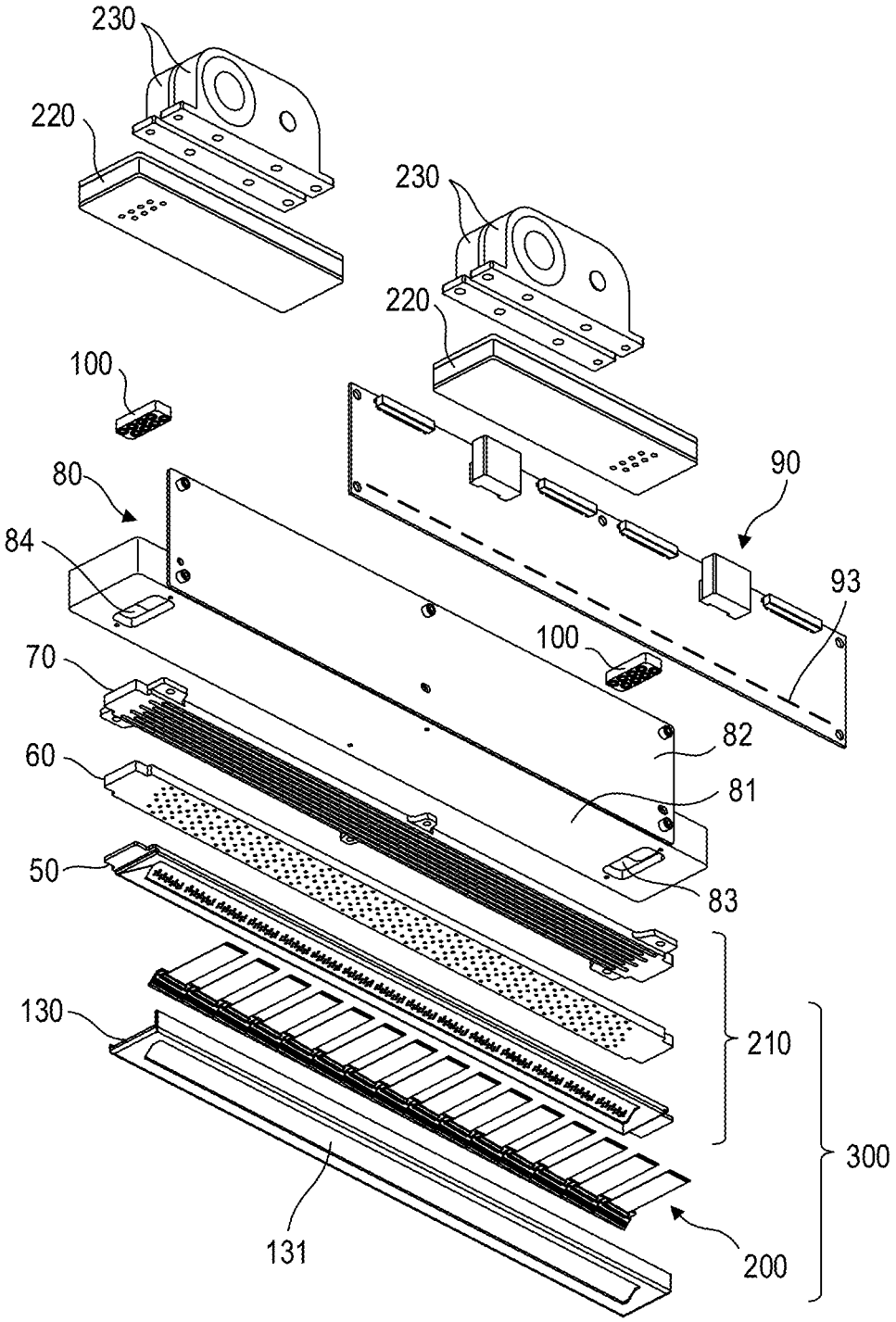
FIG. 5 is an exploded perspective view of the liquid ejection head shown in FIGS. 4A and 4B.

FIG. 5 is an exploded perspective view of respective components or units constituting the liquid ejection head 3. The liquid ejection unit 300, the liquid supply unit 220, and the electric wiring board 90 are attached to a housing 80. The liquid supply unit 220 is provided with the liquid connection portions 111 (FIG. 3), and is provided in the inside thereof with filters 221 (FIG. 2, FIG. 3) for each color communicating with respective openings of the liquid connection portions 111. The two liquid supply units 220 are provided with filters 221 for two colors, respectively. The liquid having passed through the filter 221 is supplied to the negative pressure control unit 230 disposed on the liquid supply unit 220 corresponding to each color. The negative pressure control unit 230 is a unit including pressure adjustment valves for each color, and performs the following actions by the actions of valves, spring members, and the like provided in each of the pressure adjustment valves. A change in the pressure loss in the supply system of the recording apparatus 1000 (supply system at the upstream side of the liquid ejection head 3) caused by the change in the flow rate of the liquid is greatly attenuated, so that it is possible to stabilize the negative pressure change at the downstream side (liquid ejection unit 300 side) of the pressure control unit within a certain range. As shown in FIG. 2, two pressure adjustment valves for each color are mounted in the negative pressure control unit 230 of each color. In the two pressure adjustment valves, different control pressures are set, respectively, and the high pressure side communicates with the common supply flow path 211 in the liquid ejection unit 300 and the low pressure side communicates with the common collection flow path 212 via the liquid supply unit 220.

The housing 80, which is composed of a liquid ejection unit support 81 and an electric wiring board support 82, supports the liquid ejection unit 300 and the electric wiring board 90, and secures the rigidity of the liquid ejection head 3. The electric wiring board support 82 is used for supporting the electric wiring board 90, and is fixed to the liquid ejection unit support 81 by screws. The liquid ejection unit support 81 has a role of correcting the warpage and deformation of the liquid ejection unit 300 to secure the relative position accuracy of the plurality of recording element substrates 10, and thus suppresses streaks and unevenness in recorded matter. Therefore, preferably, the liquid ejection unit support 81 has sufficient rigidity, and the material thereof is preferably a metal material such as stainless (SUS) or aluminum, or a ceramic such as alumina. The liquid ejection unit support 81 is provided with openings 83 and 84 into which joint rubber 100 is inserted. The liquid supplied from the liquid supply unit 220 is guided to a third flow path member 70 constituting the liquid ejection unit 300 via the joint rubber.

The liquid ejection unit 300 is composed of a plurality of ejection modules 200 and a flow path member 210, and a cover member 130 is attached to the surface of the liquid ejection unit 300 at the side of a recording medium. Here, as shown in FIG. 5, the cover member 130 is a member having a frame-like surface provided with an elongated opening 131, and the recording element substrate 10 and sealing member 110 (FIGS. 9A and 9B) included in the ejection module 200 are exposed through the opening 131. The frame portion around the opening 131 functions as a contact surface of a cap member that caps the liquid ejection head 3 at the time of recording standby. Therefore, it is preferred that a closed space is formed at the time of capping by applying an adhesive, a sealing material, a filling material or the like along the periphery of the opening 131 to fill the irregularities and gaps on the surface of the ejection orifice of the liquid ejection unit 300.

Next, the configuration of the flow path member 210 included in the liquid ejection unit 300 will be described. As shown in FIG. 5, the flow path member 210 is a laminate of a first flow path member 50, a second flow path member 60, and a third flow path member 70. This flow path member 210 is a flow path member for distributing the liquid supplied from the liquid supply unit 220 to the respective ejection modules 200 and returning the liquid refluxing from the ejection modules 200 to the liquid supply unit 220. The flow path member 210 is fixed to the liquid ejection unit support 81 with screws, and thus the warpage and deformation of the flow path member 210 are suppressed.

Figure 6A:
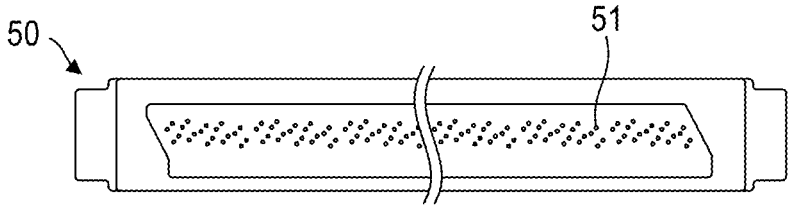
FIGS. 6A, 6B, 6C, 6D, 6E and 6F are plan views and bottom views of respective flow path members of the liquid ejection head shown in FIGS. 4A and 4B.
Figure 6B:
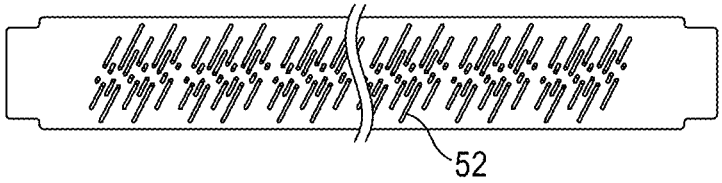
Figure 6C:
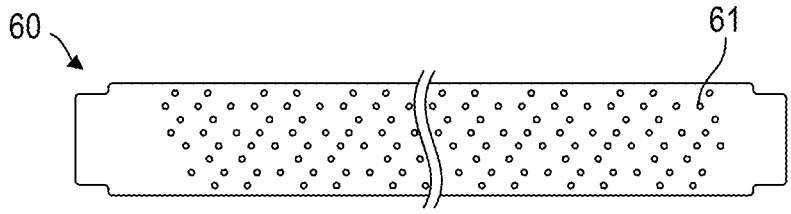
Figure 6D:
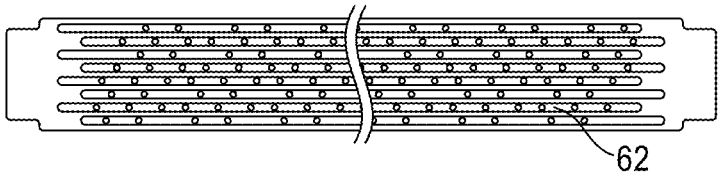
Figure 6E:
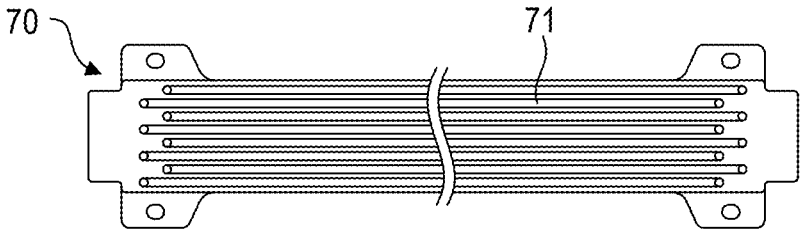
Figure 6F:
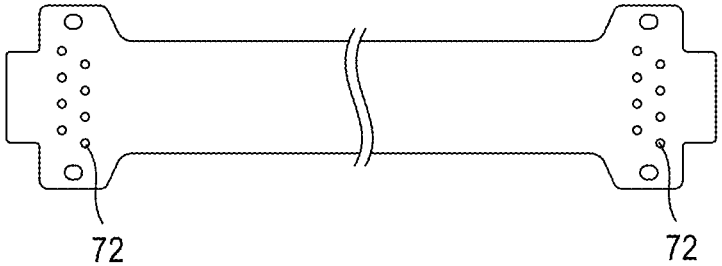
Figure 7:
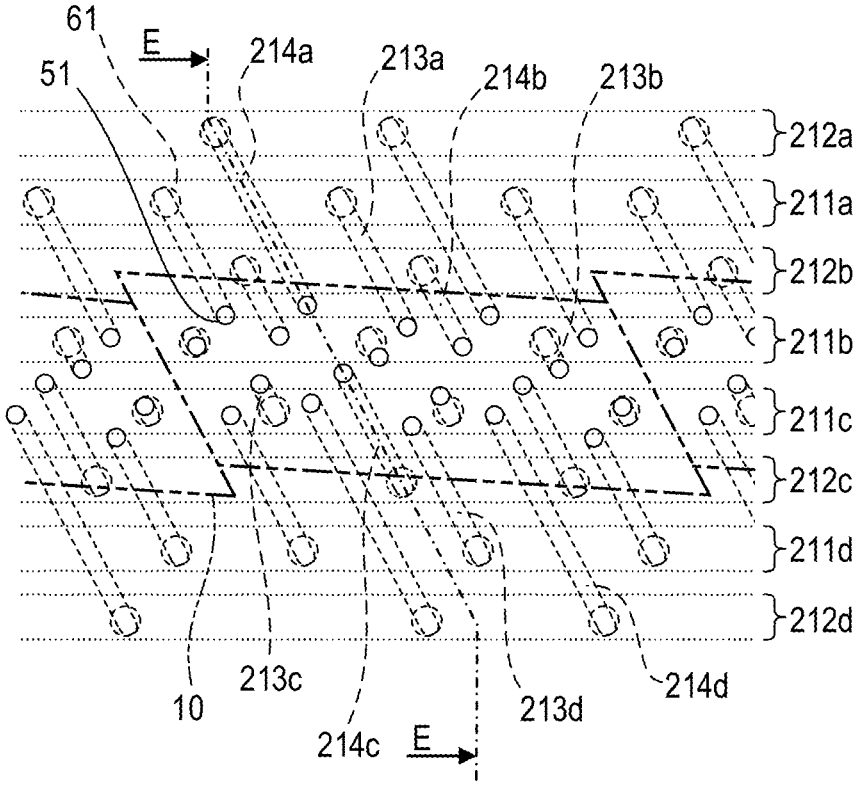
FIG. 7 is a perspective view of the flow path member shown in FIGS. 6A, 6B, 6C, 6D, 6E and 6F.

FIGS. 6A to 6F are views showing the front surface and back surface of each of the flow path members of the first to third flow path members. FIG. 6A shows the surface of the first flow path member 50 at the side where the ejection module 200 is mounted, and FIG. 6F shows the surface of the third flow path member 70 at the side in contact with the liquid ejection unit support 81. The first flow path member 50 and the second flow path member 60 are joined with each other such that the contact surfaces of these flow path members, that is, the surfaces shown in FIG. 6B and FIG. 6C, face each other, and the second flow path member 60 and the third flow path member 70 are joined with each other such that the contact surfaces of these flow path members, that is, the surfaces shown in FIG. 6D and FIG. 6E, face each other. By joining the second flow path member 60 and the third flow path member 70, eight common flow paths extending in the longitudinal direction of the flow path member are formed by the common flow path grooves 62 and 71 formed in the respective flow path members. As a result, a set of the common supply flow path 211 and the common collection flow path 212 is formed in the flow path member 210 for each color (FIG. 7). The communication port 72 of the third flow path member 70 communicates with each hole of the joint rubber 100, and is in fluidic communication with the liquid supply unit 220. A plurality of communication ports 61 are formed on the bottom surface of the common flow path groove 62 of the second flow path member 60, and communicate with one end of the individual flow path groove 52 of the first flow path member 50. A communication port 51 is formed at the other end of the individual flow path groove 52 of the first flow path member 50 and is in fluidic communication with the plurality of ejection modules 200 via the communication port 51. It is possible to concentrate the flow paths to the center of the flow path member by this individual flow path groove 52.

It is preferable that the first to third flow path members are made of a material having corrosion resistance to liquid and a low linear expansion coefficient. As the material thereof, for example, a composite material (resin material) in which alumina, liquid crystal polymer (LCP), polyphenylsulfide (PPS), or polysulfone (PSF), as a matrix material, is added to inorganic fillers such as silica fine particles and fibers, can be suitably used. As the method of forming the flow path member 210, a method of laminating three flow path members and attaching these flow path members to each other may be used, and a method of attaching the three flow path members to each other by welding may also be used when a composite resin material is selected as the material thereof.

Next, the connection relationship of the respective flow paths in the flow path member 210 will be described with reference to FIG. 7. FIG. 7 is a partially enlarged perspective view showing a flow path in the flow path member 210 formed by joining the first to third flow path members from the surface of the first flow path member 50 at the side where the ejection module 200 is mounted. The flow path member 210 is provided with common supply flow paths 211 (211*a*, 211*b*, 211*c*, and 211*d*) and common collection flow paths 212 (212*a*, 212*b*, 212*c*, and 212*d*) extending in the longitudinal direction of the liquid ejection head 3 for each color. A plurality of individual supply flow paths 213*a*, 213*b*, 213*c*, and 213*d* formed by the individual flow path grooves 52 are connected to the common supply flow path 211 of each color via the communication port 61. Further, a plurality of individual collection flow paths 214*a*, 214*b*, 214*c*, and 214*d* formed by the individual flow path grooves 52 are connected to the common collection flow path 212 of each color via the communication port 61. With such a flow path configuration, ink can be collected from each common supply flow path 211 to the recording element substrate 10 located in the central portion of the flow path member via the individual supply flow path 213. Further, the ink can be collected from the recording element substrate 10 to the common collection flow path 212 via the individual collection flow path 214.

Figure 8:
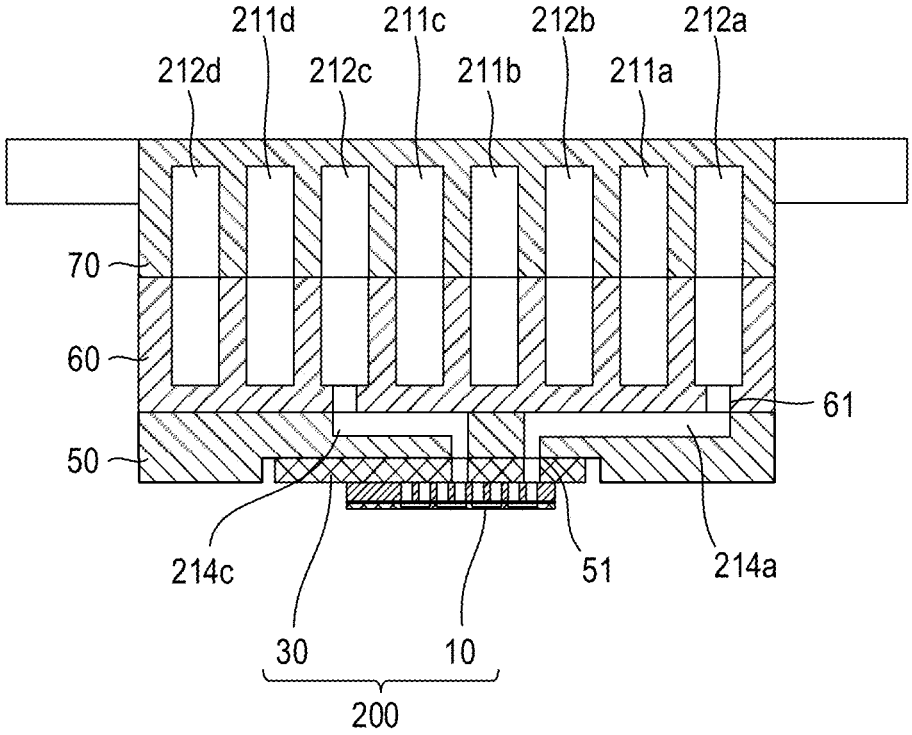
FIG. 8 is a sectional view of the liquid ejection head shown in FIGS. 4A and 4B.

FIG. 8 is a view showing a cross-section taken along the line E-E in FIG. 7. As shown in FIG. 8, each of the individual collection flow paths 214*a* and 214*c* communicates with the ejection module 200 via the communication port 51. Although only the individual collection flow paths 214*a* and 214*c* are shown in FIG. 8, in another cross section, the individual supply flow path 213 communicates with the ejection module 200 as shown in FIG. 7. A flow path for supplying ink from the first flow path member 50 to the recording element 15 (FIGS. 10A to 10C) provided on the recording element substrate 10 is formed in the support member 30 and the recording element substrate 10 included in each ejection module 200. Further, a flow path for collecting (circulating) a part or all of the liquid supplied to the recording element 15 to the first flow path member 50 is also formed. Here, the common supply flow path 211 of each color is connected to the negative pressure control unit 230 (high pressure side) of the corresponding color via the liquid supply unit 220, and the common collection flow path 212 is connected to the negative pressure control unit 230 (low pressure side) via the liquid supply unit 220. By this negative pressure control unit 230, a differential pressure (pressure difference) is generated between the common supply flow path 211 and the common collection flow path 212 by this negative pressure control unit 230. Therefore, as shown in FIGS. 7 and 8, in the liquid ejection head of the present application example to which each flow path is connected for each color, there occurs a flow in which liquid sequentially flows in order of the common supply flow path 211, the individual supply flow path 213, the recording element substrate 10, the individual collection flow path 214, and the common collection flow path 212.

(Description of Ejection Module)

Figure 9A:
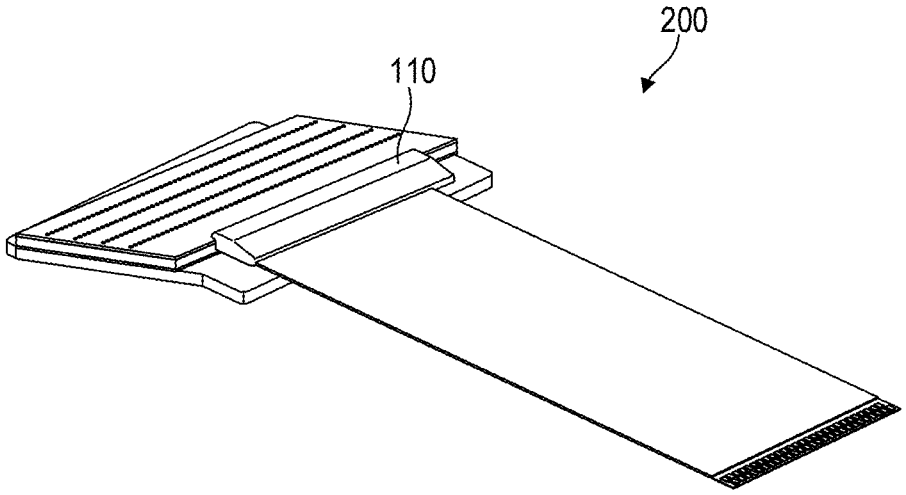
FIGS. 9A and 9B are a perspective view and an exploded perspective view of an ejection module of the liquid ejection head shown in FIGS. 4A and 4B.
Figure 9B:
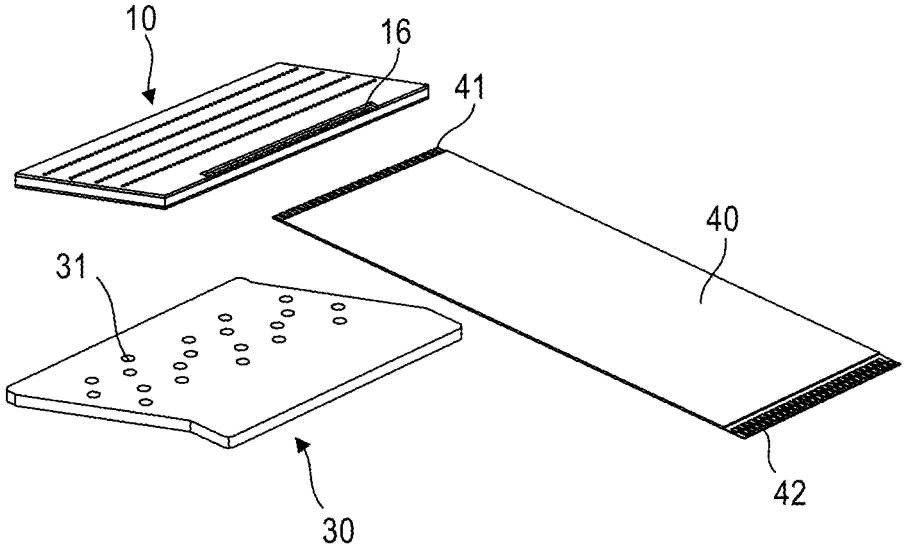

FIG. 9A shows a perspective view of one ejection module 200, and FIG. 9B shows an exploded perspective view thereof. In the method of manufacturing the ejection module 200, first, the recording element substrate 10 and the flexible wiring substrate 40 are adhered onto the support member 30 on which the liquid communication port 31 is provided in advance. Thereafter, the terminal 16 on the recording element substrate 10 and the terminal 41 on the flexible wiring substrate 40 are electrically connected to each other by wire bonding, and then the wire bonding portion (electrical connection portion) is covered with a sealant 110 and sealed. The terminal 42 of the flexible wiring substrate 40 opposite to the recording element substrate 10 is electrically connected to the connection terminal 93 of the electric wiring board 90 (refer to FIG. 5). Since the support member 30 is a support for supporting the recording element substrate 10 and is a flow path member for fluidically communicating the recording element substrate 10 and the flow path member 210, it is preferable that the support member 30 has high flatness and can be attached to the recording element substrate with sufficiently high reliability. Preferably, the material of the support member 30 is, for example, alumina or a resin material.

(Description of Structure of Recording Element Substrate)

Figure 10A:
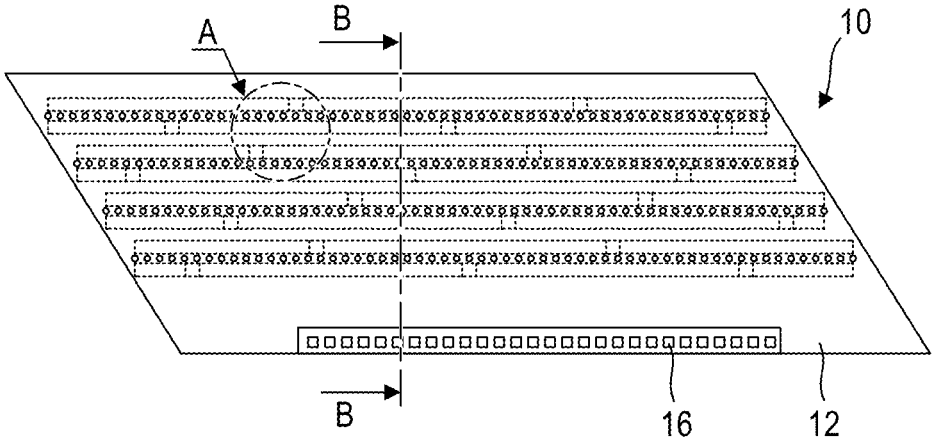
FIGS. 10A, 10B and 10C are a plan view, an enlarged plan view, and a rear view of a recording element substrate of the liquid ejection head shown in FIGS. 4A and 4B.
Figure 10B:
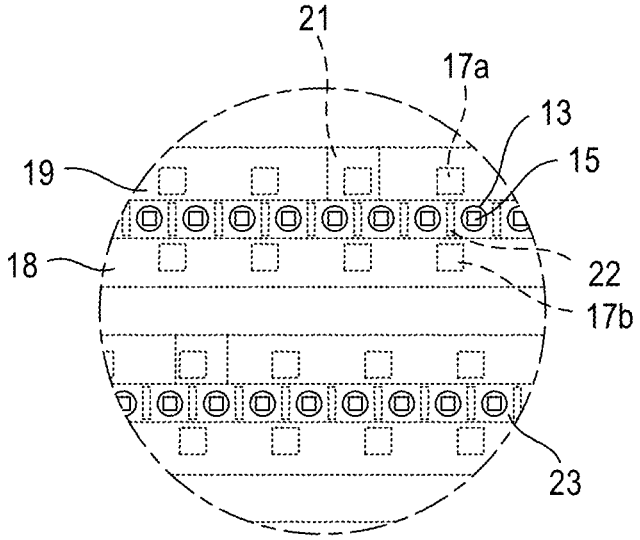
Figure 10C:
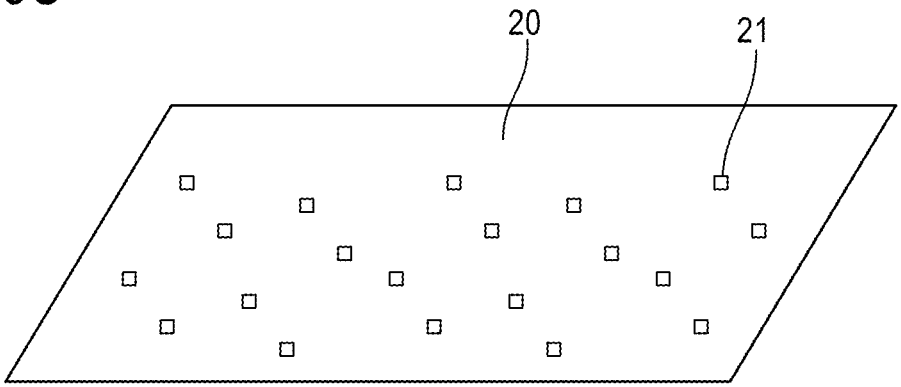

The structure of the recording element substrate 10 in the present application example will be described. FIG. 10A is a plan view of a surface of the recording element substrate 10 of the liquid ejection head on the side where the ejection orifices 13 are formed, FIG. 10B is an enlarged view of a portion indicated by A in FIG. 10A, and FIG. 10C is a bottom view of FIG. 10A. As shown in FIG. 10A, four rows of ejection orifices 13 corresponding to each ink color are formed in an ejection orifice forming member 12 of the recording element substrate 10. Hereinafter, the direction in which ejection orifice arrays in which the plurality of ejection orifices 13 are arranged extend is referred to as an "ejection orifice array direction".

As shown in FIG. 10B, a recording element (energy generating element) 15, which is a heating element for foaming a liquid with heat energy, is disposed at a position corresponding to each ejection orifice 13. A partition wall 22 defines a pressure chamber 23 having the recording element 15 therein. The recording element 15 is electrically connected to the terminal 16 in FIG. 10A by electric wiring (not shown) provided on the recording element substrate 10. Further, the recording element 15 generates heat based on the pulse signal input from the control circuit of the recording apparatus 1000 via the electric wiring board 90 (FIG. 5) and the flexible wiring substrate 40 (FIGS. 9A and 9B) and boils a liquid. The liquid is ejected from the ejection orifice 13 by a foaming force caused by the boiling. As shown in FIG. 10B, along each ejection orifice array, a liquid supply path 18 extends on one side of the ejection orifice array, and a liquid collecting path 19 extends on the other side thereof. The liquid supply path 18 and the liquid collecting path 19 are flow paths extending in the direction of the ejection orifice array provided on the recording element substrate 10, and communicate with the ejection orifice 13 via a supply port 17*a* and a collection port 17*b*, respectively.

Figure 11:
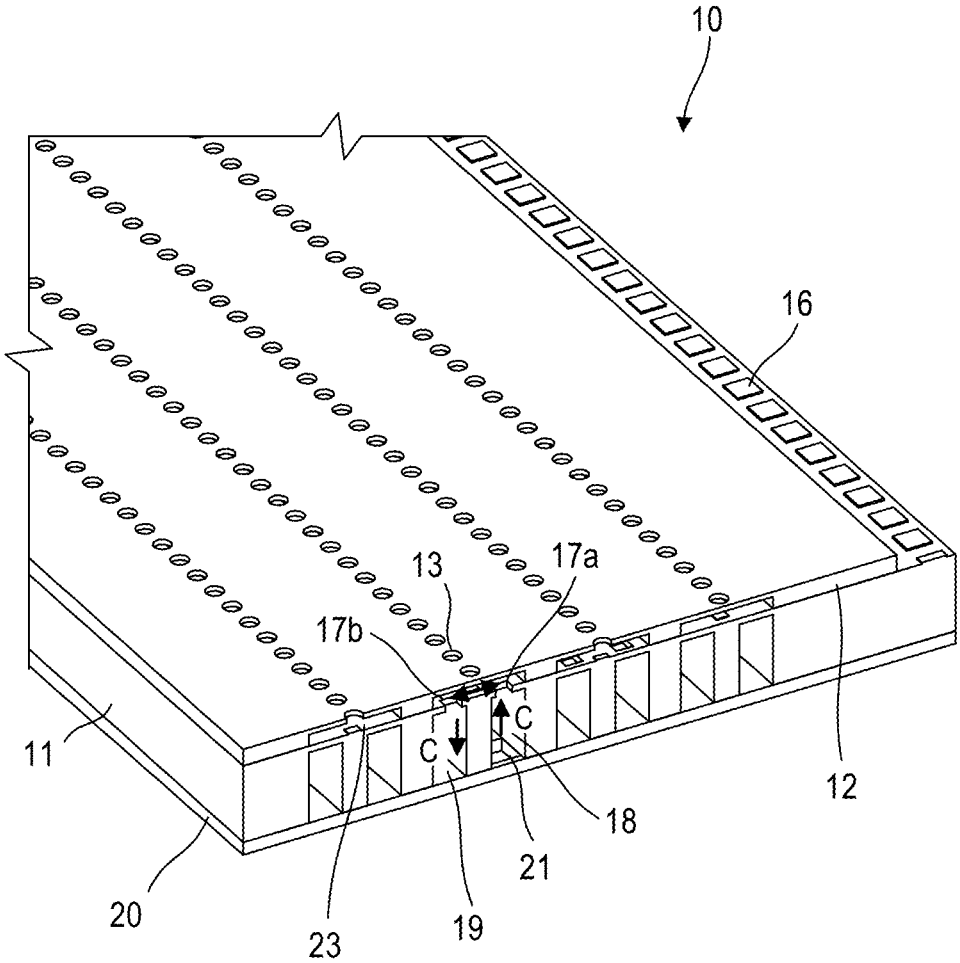
FIG. 11 is a partially cutaway perspective view of the liquid ejection head shown in FIGS. 4A and 4B.

As shown in FIGS. 10C and 11, a sheet-like lid member 20 is laminated on the back surface of the surface of the recording element substrate 10 on which the ejection orifices 13 are formed, and the lid member 20 is provided with a plurality of openings 21 communicating with the liquid supply path 18 and the liquid collecting path 19 to be described later. In the present application example, three openings 21 for one liquid supply path 18 and two openings 21 for one liquid collecting path 19 are provided on the lid member 20, respectively. As shown in FIG. 10B, the respective openings 21 of the lid member 20 communicate with the plurality of communication ports 51 shown in FIG. 6A. As shown in FIG. 11, the lid member 20 functions as a lid that forms a part of the wall of the liquid supply path 18 and the liquid collecting path 19 formed on the base plate 11 of the recording element substrate 10. The lid member 20 is preferably an object having sufficient corrosion resistance to liquid, and from the viewpoint of prevention of color mixing, high accuracy is required for the opening shape and opening position of the opening 21. Therefore, it is preferable to use the photosensitive resin material or silicon as the material of the lid member 20 and to provide the opening 21 by a photolithographic process. In this way, the lid member converts the pitch of the flow path by the opening 21, and it is preferable that the lid member is thin in consideration of pressure loss, and it is preferable that the lid member is formed of a film-like member.

Next, the flow of liquid in the recording element substrate 10 will be described. FIG. 11 is a perspective view showing a cross-section of the recording element substrate 10 and the lid member 20 taken along line B-B of FIG. 10A. The recording element substrate 10 is configured such that a base plate 11 formed of Si and an ejection orifice forming member 12 formed of photosensitive resin are laminated, and the lid member 20 is attached to the back surface of the base plate 11. Recording elements 15 are formed at one side of the base plate 11 (FIGS. 10A to 10C), and grooves constituting the liquid supply path 18 and the liquid collecting path 19 extending along the ejection orifice array are formed at the other side thereof. The liquid supply path 18 and the liquid collecting path 19 formed by the base plate 11 and the lid member 20 are connected to the common supply flow path 211 and the common collection flow path 212 in the flow path member 210, and a differential pressure is generated between the liquid supply path 18 and the liquid collecting path 19. When liquid is ejected from the plurality of ejection orifices 13 of the liquid ejection head 3, in the ejection orifice not performing an ejection operation, the liquid in the liquid supply path 18 provided in the base plate 11 flows to the liquid collecting path 19 via the supply port 17*a*, the pressure chamber 23, and the collection port 17*b* by the aforementioned differential pressure. This flow is indicated by arrow C in FIGS. 10A to 10C. This flow makes it possible to collect thickened ink, bubbles, foreign matters, and the like caused by evaporation from the ejection orifices 13 into the liquid collecting path 19 in the ejection orifice 13 and the pressure chamber 23 at which recording is suspended. Further, this flow makes it possible to suppress an increase in viscosity of the ink in the ejection orifice 13 and the pressure chamber 23. The liquid collected into the liquid collecting path 19 is collected in order of the communication port 51, the individual collection flow path 214, and the common collection flow path 212 in the flow path member 210 through the opening 21 of the lid member 20 and the liquid communication port 31 (refer to FIG. 9B) of the support member 30. Finally, the liquid is collected into the supply path of the recording apparatus 1000.

That is, the liquid supplied from the recording apparatus main body to the liquid ejection head 3 flows in the following order, and is supplied and collected. The liquid first flows into the liquid ejection head 3 from the liquid connection portion 111 of the liquid supply unit 220. Further, the liquid is supplied in order of the joint rubber 100, the communication port 72 and the common flow path groove 71 provided in the third flow path member, the common flow path groove 62 and the communication port 61 provided in the second flow path member, and the individual flow path groove 52 and the communication port 51 provided in the first flow path member. Thereafter, the liquid is supplied to the pressure chamber 23 via the liquid communication port 31 provided in the support member 30, the opening 21 provided in the lid member, and the liquid supply path 18 and the supply port 17*a* provided in the base plate 11 in the order mentioned. Among the liquids supplied to the pressure chamber 23, the liquid not ejected from the ejection orifice 13 flows to the collection port 17*b* and the liquid collecting path 19 provided in the base plate 11, the opening 21 provided in the lid member, and the liquid communication port 31 provided in the support member 30 in the order mentioned. Thereafter, the liquid flows to the communication port 51 and the individual flow path groove 52 provided in the first flow path member, the communication port 61 and the common flow path groove 62 provided in the second flow path member, the common flow path groove 71 and the communication port 72 provided in the third flow path member 70, and the joint rubber 100 in the order mentioned. Then, the liquid flows from the liquid connection portion 111 provided in the liquid supply unit to the outside of the liquid ejection head 3. In the form of the first circulation path shown in FIG. 2, the liquid inflowing from the liquid connection portion 111 is supplied to the joint rubber 100 after passing through the negative pressure control unit 230. In the form of the second circulation path shown in FIG. 3, the liquid recovered from the pressure chamber 23 flows from the liquid connection portion 111 to the outside of the liquid ejection head via the negative pressure control unit 230 after passing through the joint rubber 100.

As shown in FIGS. 2 and 3, the entire liquid inflowing from one end of the common supply flow path 211 of the liquid ejection unit 300 is not supplied to the pressure chamber 23 via the individual supply flow path 213*a*. There is also a liquid that flows from the other end of the common supply flow path 211 to the liquid supply unit 220 without flowing into the individual supply flow path 213*a*. In this way, a path that flows without passing through the recording element substrate 10 is provided, so that it is possible to suppress the backflow of a circulation flow of the liquid even in the case of having the recording element substrate 10 having a fine flow path with large flow path resistance as in the present application example. In this way, in the liquid ejection head of the present application example, it is possible to suppress an increase in viscosity of the liquid in the vicinity of the pressure chamber and the ejection orifice, so that it is possible to suppress misdirection of ejection and ejection failure, with the result that high-quality recording can be performed.

(Description of Position Relationship Between Recording Element Substrates)

Figure 12:
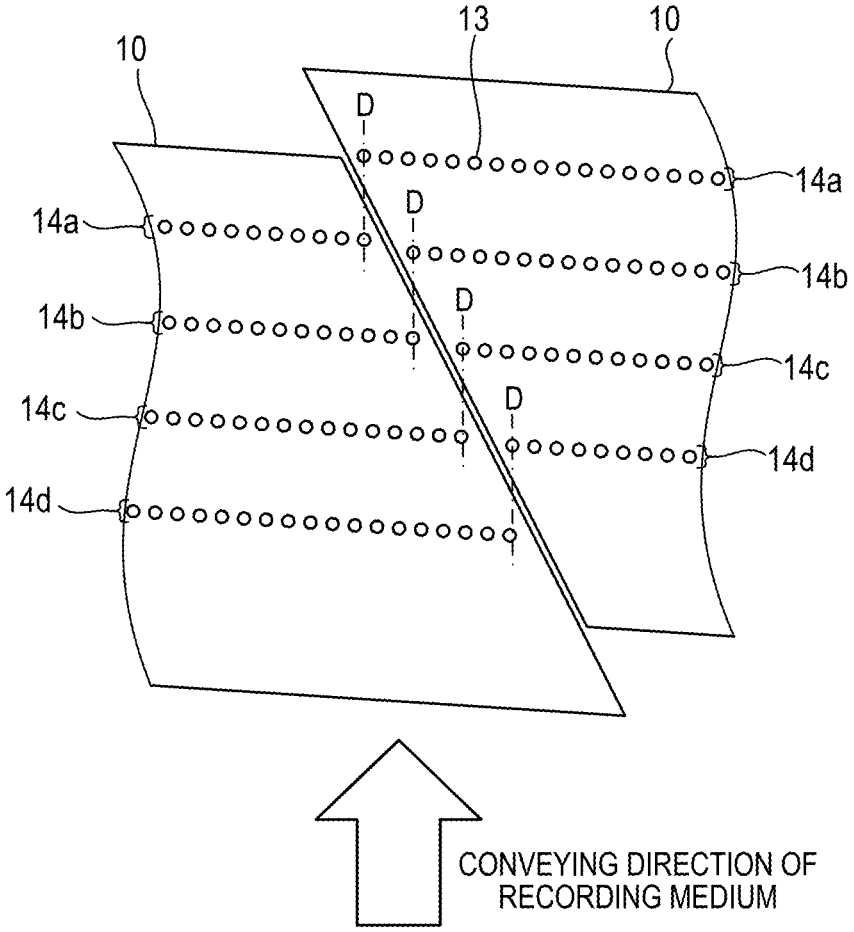
FIG. 12 is an enlarged plan view of a main part showing two adjacent recording element substrates of the liquid ejection head shown in FIGS. 4A and 4B.

FIG. 12 is a partially enlarged plan view showing an adjacent portion of the recording element substrate in two adjacent ejection modules. As shown in FIGS. 10A to 10C, in the present application example, a substantially parallelogram-shaped recording element substrate is used. As shown in FIG. 12, in each recording element substrate 10, the respective ejection orifice arrays 14*a* to 14*d*, in each which the ejection orifices 13 are arrayed, are arranged to be inclined by a certain angle with respect to the conveying direction of the recording medium. Thus, at least one ejection orifice of the ejection orifice array at the adjacent portion of the recording element substrates 10 overlaps in the conveying direction of the recording medium. In FIG. 12, two ejection orifices on the D line overlap each other. With such an arrangement, even if the position of the recording element substrate 10 deviates somewhat from a predetermined position, it is possible to make black streaks or white spots of recorded images inconspicuous by drive control of overlapping ejection orifices. Even when the plurality of recording element substrates 10 are arranged in a straight line (in-line) rather than in a staggered arrangement, by the configuration in FIG. 12, it is possible to suppress the black streaks and white spots at the connecting portion between the recording element substrates 10 while suppressing an increase in the length of the liquid ejection head 3 in the conveying direction of the recording medium. In the present application example, the principal plane of the recording element substrate is a parallelogram, but the present disclosure is not limited thereto. Even when a recording element substrate having a rectangular shape, a trapezoidal shape or another shape is used, the configuration of the present disclosure can be preferably applied.

(Description of Vicinity of Ejection Orifice)

Figure 13A:
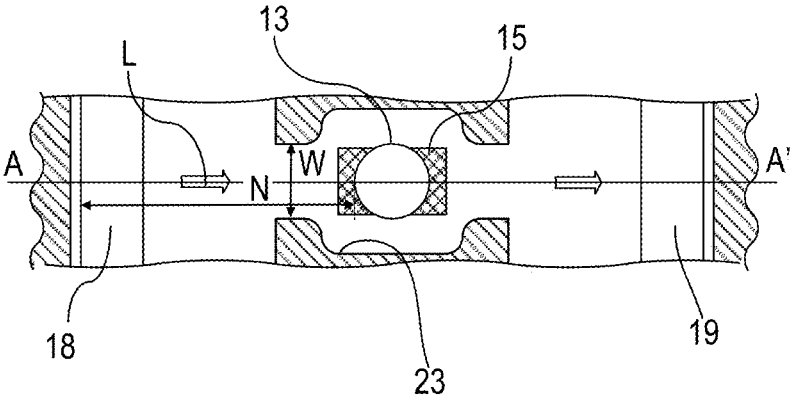
FIGS. 13A, 13B and 13C are a cross-sectional view, a longitudinal sectional view, and a perspective view of a liquid ejection head according to a first embodiment of the present disclosure.
Figure 13B:
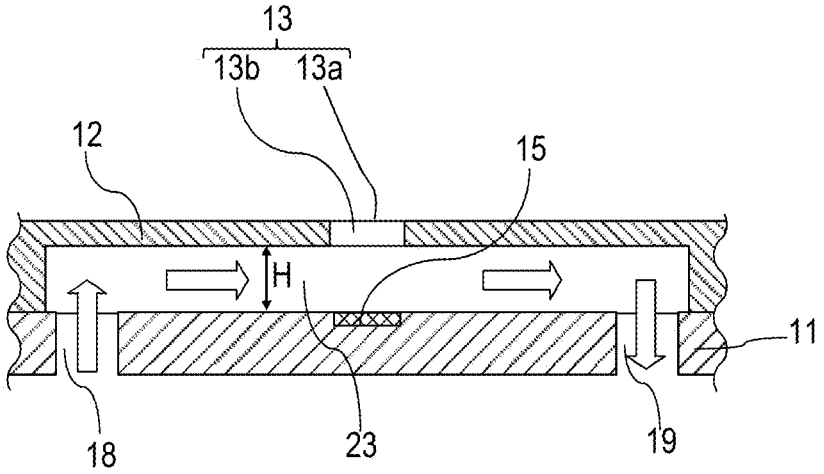
Figure 13C:
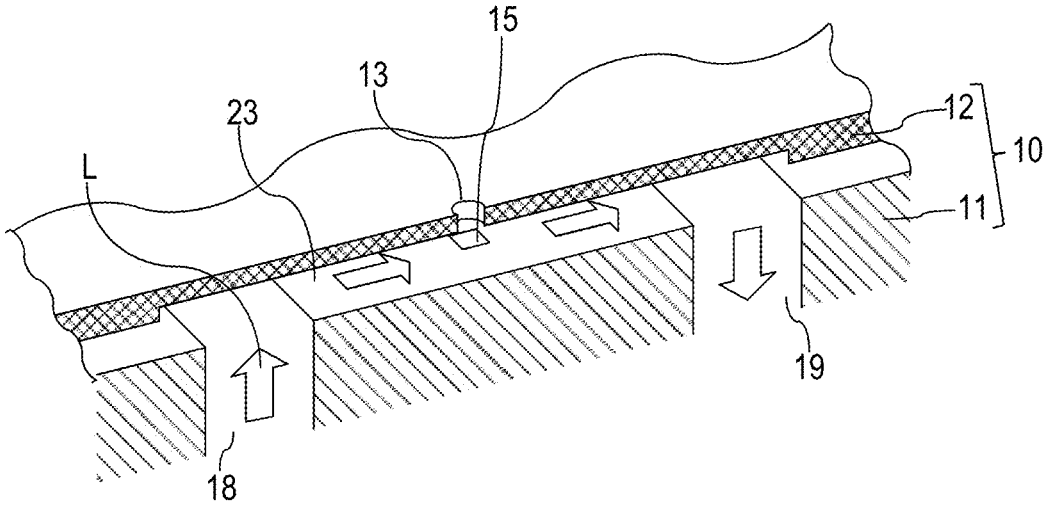

FIGS. 13A to 13C are schematic views specifically illustrating the vicinity of the ejection orifice of the liquid ejection head 3 that ejects liquid such as ink according to a first embodiment of the present disclosure. FIG. 13A is a plan view seen in the ejection direction of liquid droplets ejected from the ejection orifice, FIG. 13B is a cross-sectional view taken along the line A-A in FIG. 13A, and FIG. 13C is a perspective view including a cross-section taken along line A-A of FIG. 13A. As shown in FIGS. 13A to 13C, the recording element substrate 10 (refer to FIG. 11) of the liquid ejection head 3 includes an ejection orifice 13, a pressure chamber 23 containing an energy generating element 15 and facing the ejection orifice 13, and a liquid supply path 18 and a liquid collecting path 19 connected to the pressure chamber 23. The pressure chamber 23 is supplied with liquid from one end side to the other end side, and the ejection orifice 13 communicates with the pressure chamber 23 located between the liquid supply path 18 and the liquid collecting path 19. More specifically, as shown in FIGS. 13B and 13C, an energy generating element 15 is formed on a recording element substrate 10 made of silicon (Si). The ejection orifice plate forming member (orifice plate) 12 laminated on the recording element substrate 10 is provided with the ejection orifice 13. The ejection orifice 13 is composed of an opening portion 13*a* and an ejection orifice portion 13*b* communicating with the opening portion 13*a* and the pressure chamber 23. The opening portion 13*a* is an opening formed on the surface of the ejection orifice forming member 12 (surface of a side on which liquid droplets are ejected), and the ejection orifice portion 13*b* is a cylindrical portion that connects the opening portion 13*a* and the pressure chamber 23.

A meniscus of the supplied liquid is generated at the ejection orifice 13, and an ejection orifice interface which is an interface between liquid and atmosphere is formed at the ejection orifice 13. For example, bubbles are generated in the liquid by driving an electrothermal converting element (heater) which is an example of the energy generating element 15, and the liquid is ejected from the ejection orifice 13 by the pressure of the bubbles. However, the energy generating element 15 is not limited to a heater, and various energy generating elements such as a piezoelectric element can be used, for example. In the liquid ejection head 3, the liquid supply path 18 and the liquid collecting path 19 that are connected to both ends of the pressure chamber 23 and extend in a direction intersecting the flow of the liquid passing through the pressure chamber 23 are formed as through holes of the recording element substrate 10. Moreover, the liquid supply path 18 communicates with the opening 21 which is an inlet of the liquid to the liquid ejection head 3, and the outflow path 16 communicates with the opening 21 which is an outlet of the liquid from the liquid ejection head 3 to the outside. As such, in the liquid ejection head 3, a liquid path through which the liquid is supplied in order of the opening 21, the liquid supply path 18, the pressure chamber 23, the ejection orifice 13, the liquid collecting path 19, and the opening 21 is formed. In the present embodiment, a so-called circulation path through which the liquid flowing out of the liquid ejection head 3 from the opening 21 flows into the opening 21 of the liquid ejection head 3 again is formed, and a circulation flow L is formed in the liquid ejection head 3. In the present embodiment, liquid droplets are ejected from the ejection orifice 13 by driving the energy generating element 15 in a state in which liquid flows through the pressure chamber 23. The speed of the circulation flow L flowing in the pressure chamber 23 is, for example, about 0.1 to 100 mm/s, and even if an ejection operation is performed in a state where the liquid is flowing, the influence on the landing precision and the like is small.

First Embodiment

Figure 14A:
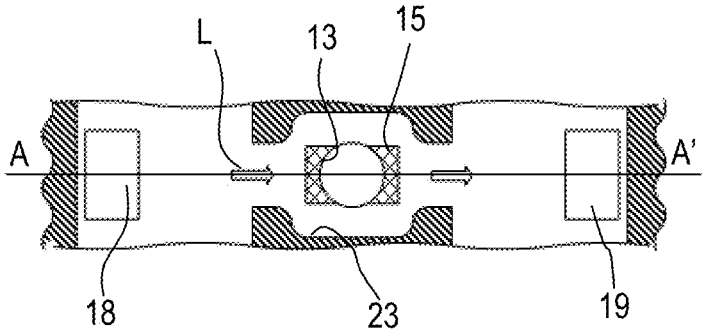
FIGS. 14A, 14B, 14C and 14D are cross-sectional views and longitudinal sectional views of a liquid ejection head of a first reference example.
Figure 14B:
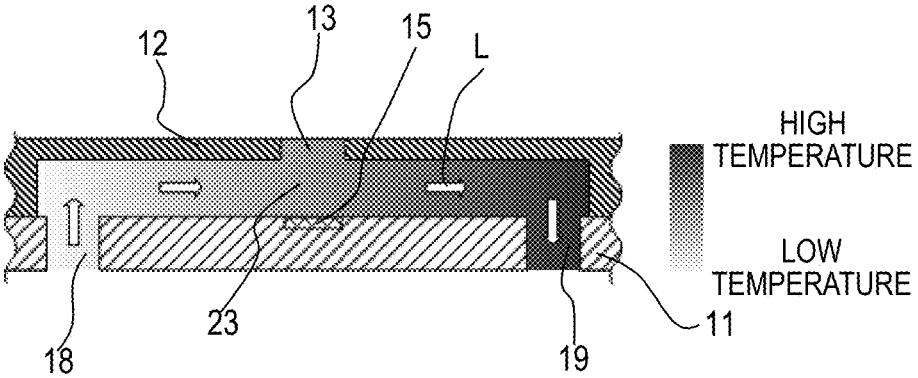
Figure 14C:
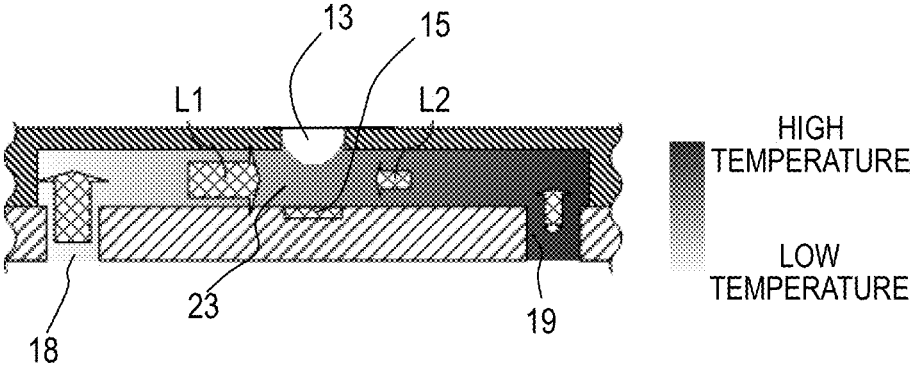
Figure 14D:
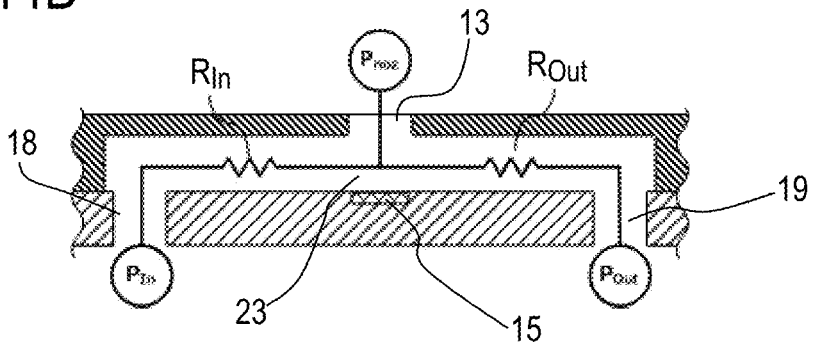
Figure 15A:
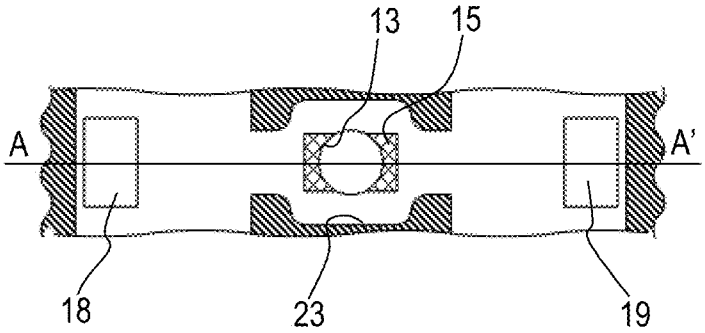
FIGS. 15A, 15B, 15C and 15D are cross-sectional views and longitudinal sectional views of a liquid ejection head of a second reference example.
Figure 15B:
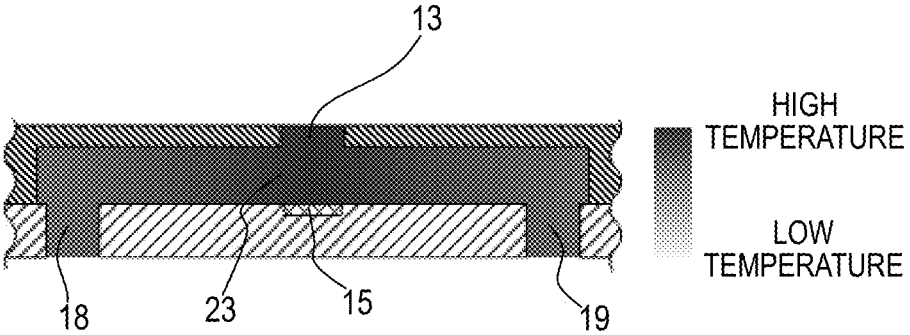
Figure 15C:
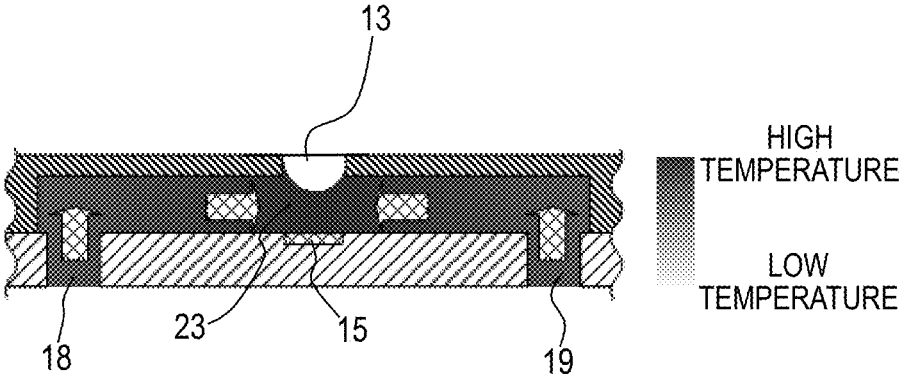
Figure 15D:
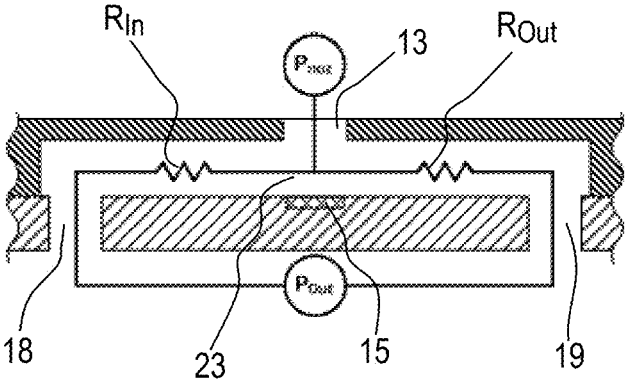
Figure 16A:
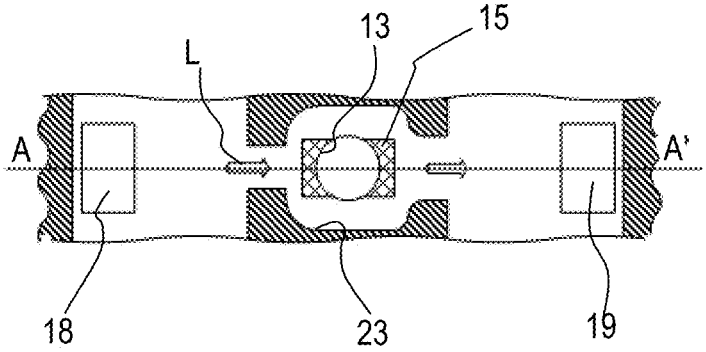
FIGS. 16A, 16B, 16C and 16D are cross-sectional views and longitudinal sectional views of a liquid ejection head according to a first embodiment of the present disclosure.
Figure 16B:
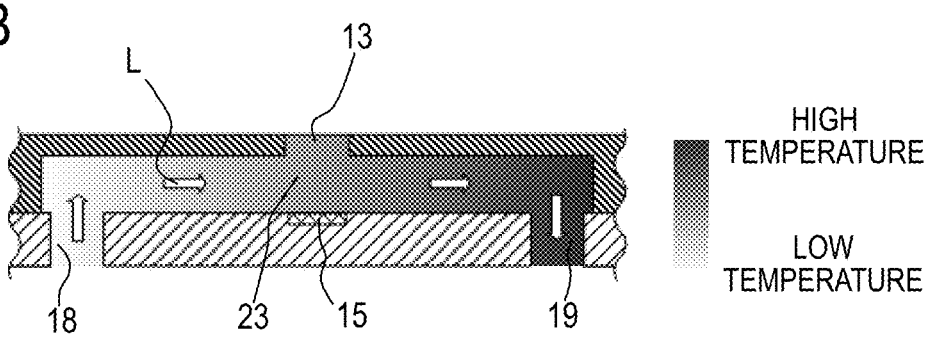
Figure 16C:
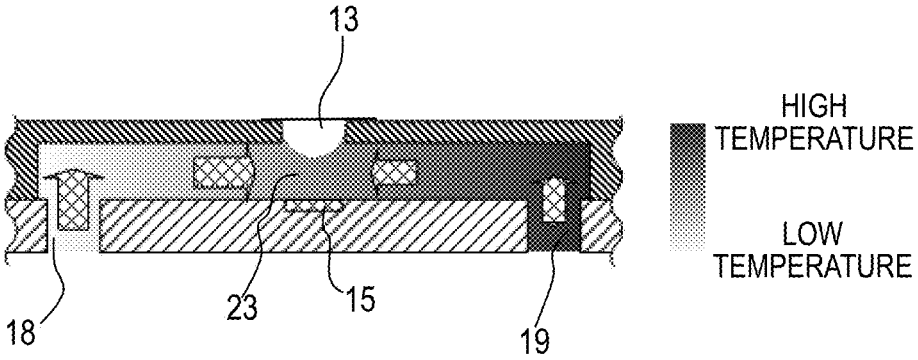
Figure 16D:
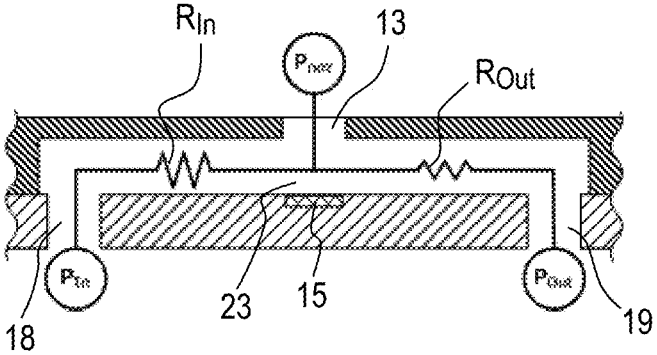
Figure 17:
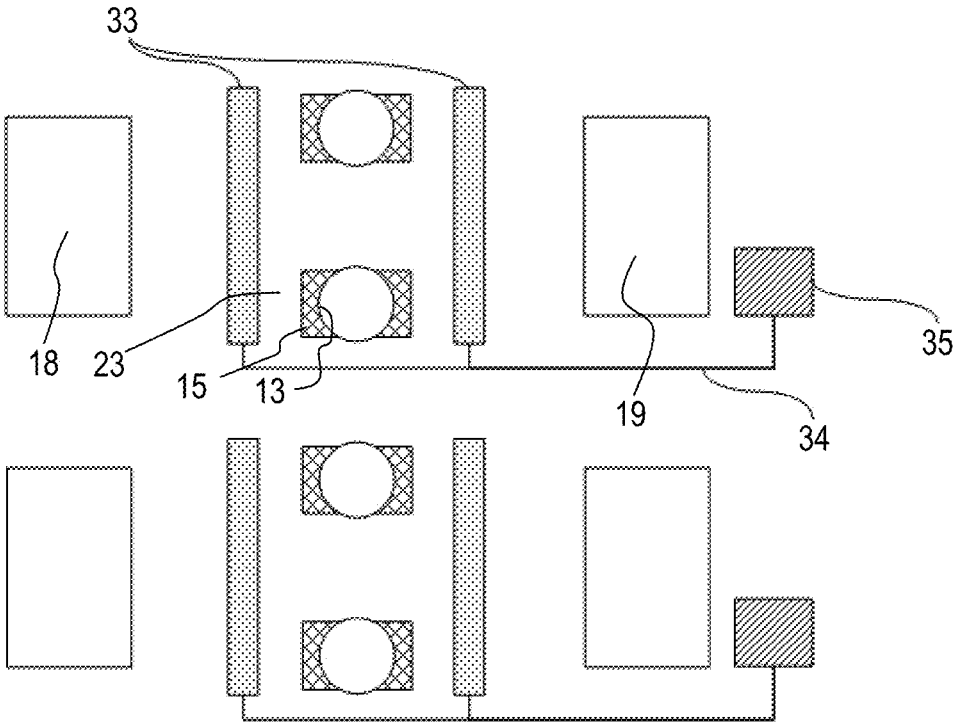
FIG. 17 is a plan view schematically showing a temperature adjustment mechanism of a liquid ejection head according to a first embodiment of the present disclosure.

Hereinafter, a first embodiment of the present disclosure will be described with reference to FIGS. 14A to 17. FIGS. 14A, 15A and 16A are cross-sectional views schematically showing a liquid ejection head 3 having a flow path including a pressure chamber 23, an ejection orifice 13, and an energy generating element 15. FIGS. 14B to 14D, 15B to 15D, 16B to 16D are sectional views taken along the line A-A in FIGS. 14A, 15A and 16A. FIGS. 14B, 15B and 16B are schematic views showing a state in which a liquid is not ejected, and FIGS. 14C, 15C and 16C are schematic views showing a state in which a liquid is ejected. FIGS. 14D, 15D and 16D are schematic views showing the flow resistance and pressure of the flow path of each liquid ejection head 3. FIG. 17 is a cross-sectional view schematically showing a temperature adjustment mechanism of the present embodiment.

In FIGS. 14A to 14D, as shown in FIG. 14D, in the liquid ejection head 3 similar to conventional one in which the flow resistance of the liquid supply path 18 at the upstream side of the ejection orifice 13 is equal to the flow resistance of the liquid collecting path 19 at the downstream side, an example of generating a circulation flow L passing through the liquid ejection head 3 is exemplified. When the liquid is ejected as shown in FIG. 14C in a state in which the circulation flow L is generated as shown in FIG. 14B, liquid droplets are pulled by the flow ejected from the ejection orifice 13, and thus the liquid flows into the pressure chamber 23 from both a supply side (IN side) and a collection side (OUT side).

In FIGS. 15A to 15D, as shown in FIG. 15D, in the liquid ejection head 3 similar to conventional one in which the flow resistance of the liquid supply path 18 at the upstream side of the ejection orifice 13 is equal to the flow resistance of the liquid collecting path 19 at the downstream side, an example of not generating a circulation flow L passing through the liquid ejection head 3 is exemplified. When the liquid is ejected as shown in FIG. 15C in a state in which the circulation flow L is not generated as shown in FIG. 15B, liquid droplets are pulled by the flow ejected from the ejection orifice 13, and thus the liquid flows into the pressure chamber 23 from both a supply side and a collection side.

In FIGS. 16A to 16D, as shown in FIG. 16D, in the liquid ejection head 3 of the present embodiment in which the flow resistance of the liquid supply path 18 at the upstream side of the ejection orifice 13 is greater than the flow resistance of the liquid collecting path 19 at the downstream side, an example of generating a circulation flow L passing through the liquid ejection head 3 is exemplified. When the liquid is ejected as shown in FIG. 16C in a state in which the circulation flow L is generated as shown in FIG. 16B, liquid droplets are pulled by the flow ejected from the ejection orifice 13, and thus the liquid flows into the pressure chamber 23 from both a supply side and a collection side.

Generally, in the case of ejecting the liquid thickened by the evaporation of liquid from the ejection orifice 13, there is a case of increasing the temperature in the vicinity of the ejection orifice 13 to lower the viscosity of a liquid and then ejecting the liquid. When the liquid is set to a temperature of 40° C. to 60° C., the viscosity of the liquid can be set to ½ of the viscosity thereof at room temperature (for example, about 20° C. to 30° C.). Thus, when the viscosity of the liquid is lowered, there are two merits as follows.

(1) Ejection efficiency is improved because the liquid smoothly passes through the ejection orifice 13.

(2) Refilling is improved because the liquid is smoothly supplied to the ejection orifice 13.

The temperature adjustment of the liquid in the flow path including the pressure chamber 23, for example, as shown in FIG. 17, can be performed by providing a heater (sub-heater) 33 separate from a heater for ejection in the flow path and driving the sub-heater 33 by a driver 35 connected via a wiring 34. The temperature adjustment mechanism having such a configuration is advantageous in that temperature adjustment control can be performed by control independent of an electrical signal for image formation and in that the temperature of the flow path of the entire recording element substrate 10 as well as the temperature of the pressure chamber 23 is adjusted, and thus it is easy to perform uniform temperature adjustment (heating) of the entire liquid in the flow path.

Here, in the case of generating the circulation flow L passing through the liquid ejection head 3 shown in FIGS. 14A to 14D (first reference example), when liquid is ejected as described above, the liquid flows into the pressure chamber 23 from both the supply side (IN side) and the collection side (OUT side). At this time, at the collection side, liquid is discharged from the pressure chamber 23 in the circulation flow L at the time of non-ejection, but liquid flows into the pressure chamber 23 against the circulation flow L in accordance with liquid ejection. In contrast, at the supply side, in addition to supplying the liquid to the pressure chamber 23 in the circulation flow L, a larger amount of liquid flows into the pressure chamber 23 in accordance with liquid ejection. Therefore, as schematically shown in FIG. 14C, the amount of the liquid L1 supplied from the supply side to the pressure chamber 23 is larger than the amount of the liquid L2 supplied from the collection side to the pressure chamber 23. The liquid at the collection side once passes through the pressure chamber 23 in which the energy generating element 15 is provided, whereas the liquid at the supply side is in a stage before reaching the pressure chamber 23. Therefore, the liquid at the supply side is usually at a lower temperature than the liquid at the collection side. That is, in the configuration shown in FIGS. 14A to 14D, a large amount of low-temperature liquid flows into the pressure chamber 23. Here, in the flow path at the supply side, flow resistance is represented by $R_{In}$, and pressure is represented by $P_{In}$, and in the flow path at the collection side, flow resistance is represented by $R_{Out}$, and pressure is represented by $P_{Out}$. The flow resistance $R_{In}$ of the flow path at the supply side is defined as a flow resistance of the flow path that combines the liquid supply path 18 with the flow path from the liquid supply path 18 to the ejection orifice 13. The flow resistance $R_{Out}$ of the flow path at the collection side is defined as a flow resistance of the flow path that combines the flow path from the ejection orifice 13 to the liquid collecting path 19 with the liquid collecting path 19. In the case of generating the circulation flow L, the pressure $P_{In}$ of the flow path at the supply side is higher than the pressure $P_{Out}$ of the flow path at the collection side. Further, in the configuration shown in FIGS. 14A to 14D, the flow resistance $R_{In}$ of the flow path at the supply side is equal to the flow resistance $R_{Out}$ of the flow path at the collection side. In this case, based on the difference between the pressure $P_{In}$ of the flow path at the supply side and the pressure $P_{Out}$ of the flow path at the collection side, at the time of liquid ejection, the amount of low-temperature liquid supplied from the supply side to the vicinity of the ejection orifice 13 is larger than the amount of high-temperature liquid supplied from the collection side to the vicinity of the ejection orifice 13. Therefore, the amount of heat necessary for temperature adjustment (heating) for lowering the viscosity of the liquid is large, and thus the amount of electric power required for obtaining the amount of heat is large.

In the case of not generating the circulation flow L passing through the liquid ejection head 3 shown in FIGS. 15A to 15D (second reference example), as schematically shown in FIG. 15C, at the time of liquid ejection, approximately the same amount of liquid inflows from both the supply side and the collection side. That is, in order not to generate the circulation flow L, the pressure $P_{In}$ of the flow path at the supply side is substantially equal to the pressure $P_{Out}$ of the flow path at the collection side. Further, in the configuration shown in FIGS. 15A to 15D, the flow resistance $R_{In}$ of the flow path at the supply side is equal to the flow resistance $R_{Out}$ of the flow path at the collection side. In this configuration, at the time of liquid ejection, the amount of low-temperature liquid supplied from the supply side to the vicinity of the ejection orifice 13 is substantially equal to the amount of high-temperature liquid supplied from the collection side to the vicinity of the ejection orifice 13. Therefore, since a large amount of the low-temperature liquid does not particularly flow into the vicinity of the ejection orifice 13, the amount of heat and the amount of electric power required for temperature adjustment for lowering the viscosity of the liquid are not particularly large. However, when the circulation flow L of the liquid is generated, it is not possible to obtain an advantage of suppressing the evaporation of volatile components in the liquid from the ejection orifice 13.

Thus, when the circulation flow L passing through the liquid ejection head 3 is generated, it is desired to suppress the amount of heat and the amount of electric power necessary for temperature adjustment to lower the viscosity of the liquid while maintaining the advantage of suppressing the evaporation of volatile components in the liquid from the ejection orifice 13. The present disclosure employs a configuration where the flow resistance of the flow path at the upstream side of the ejection orifice 13 is not equal to the flow resistance of the flow path at the downstream side as shown in FIGS. 14A to 14D and 15A to 15D, and the flow resistance of the flow path at the upstream side of the ejection orifice 13 is greater than the flow resistance of the flow path at the downstream side as shown in FIGS. 16A to 16D. That is, in order to generate the circulation flow L, the pressure $P_{In}$ of the flow path at the supply side is higher than the pressure $P_{Out}$ of the flow path at the collection side ($P_{In}>P_{Out}$), and the flow resistance $R_{In}$ of the flow path at the supply side is higher than the flow resistance $R_{Out}$ of the flow path at the collection side ($R_{In}>R_{Out}$). Therefore, the difference between the flow resistance $R_{In}$ of the flow path at the supply side and the flow resistance $R_{Out}$ of the flow path at the collection side cancels the difference between the pressure $P_{In}$ of the flow path at the supply side and the pressure $P_{Out}$ of the flow path at the collection side to some extent. As a result, at the time of liquid ejection, it is possible to suppress the amount of low-temperature liquid supplied from the supply side to the vicinity of the ejection orifice 13 to the same level as the amount of high-temperature liquid supplied from the collection side to the vicinity of the ejection orifice 13. Therefore, since the temperature of the liquid in the vicinity of the ejection orifice 13 does not excessively become low, the amount of heat and the amount of electric power required for temperature adjustment for lowering the viscosity is suppressed to be small.

This configuration in which the flow resistance $R_{In}$ of the flow path at the supply side is greater than the flow resistance $R_{Out}$ of the flow path at the collection side can be realized, for example, by narrowing at least a part of the flow path at the supply side to increase the flow resistance $R_{In}$. That is, in this configuration, the width W (refer to FIGS. 13A to 13C) of at least a part of the supply-side flow path including the liquid supply path 18 is smaller than the width of the collection-side flow path including the liquid collecting path 19, so that the flow resistance $R_{In}$ increases. However, instead of narrowing the width W of the flow path, the flow resistance $R_{In}$ of the flow path at the supply side may be made larger than the flow resistance $R_{Out}$ of the flow path at the collection side by other methods. For example, at the supply side and the collection side, the height H (refer to FIGS. 13A to 13C) of the flow path may be made different (the size in the height direction of at least a part of the flow path may be decreased and narrowed), and the length N (refer to FIGS. 13A to 13C) of the flow path may be made different, so that the flow resistance may be adjusted to the intensity of $R_{In}$ and $R_{Out}$.

Second Embodiment

Figure 18A:
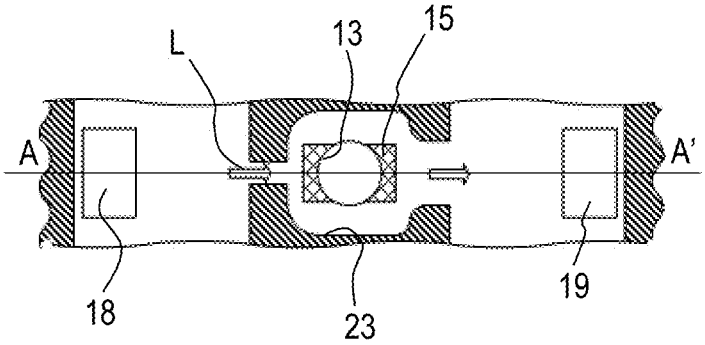
FIGS. 18A, 18B, 18C and 18D are cross-sectional views and longitudinal sectional views of a liquid ejection head according to a modification example of the first embodiment of the present disclosure.
Figure 18B:
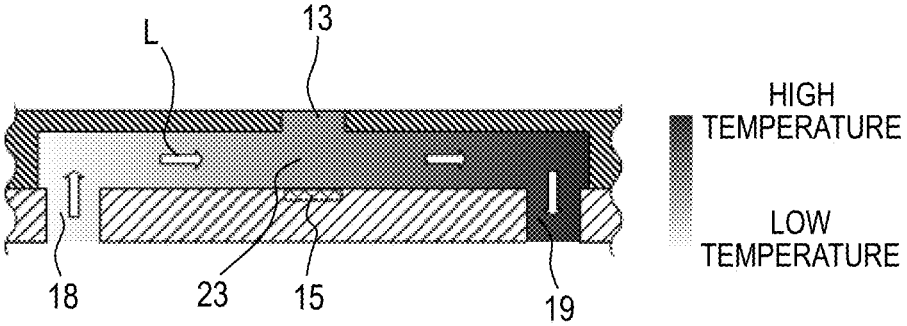
Figure 18C:
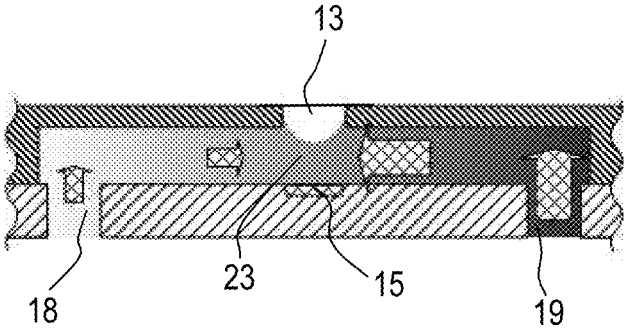
Figure 18D:
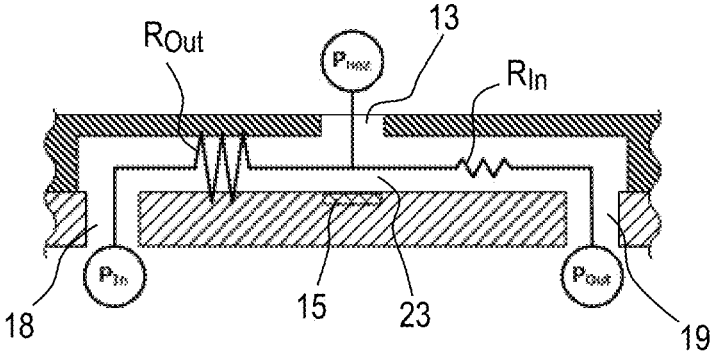
Figure 19A:
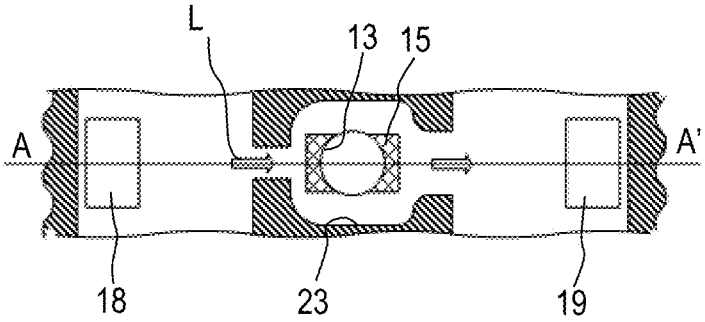
FIGS. 19A, 19B, 19C and 19D are cross-sectional views and longitudinal sectional views of a liquid ejection head according to a second embodiment of the present disclosure.
Figure 19B:
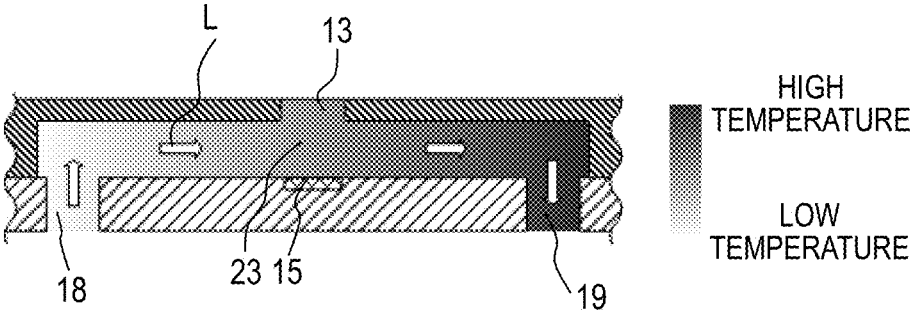
Figure 19C:
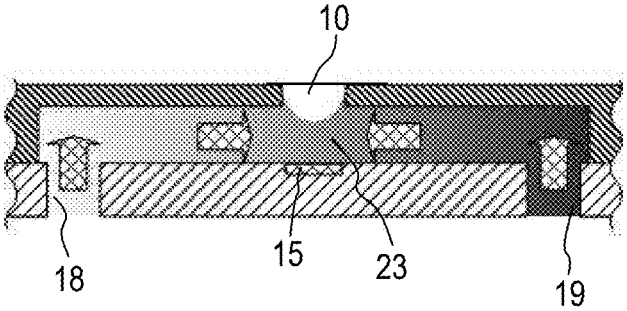
Figure 19D:
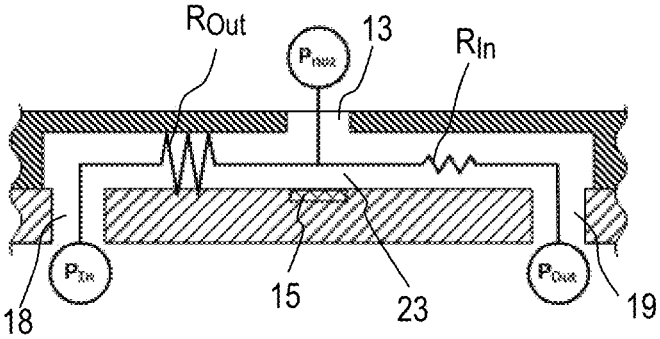
Figure 20:
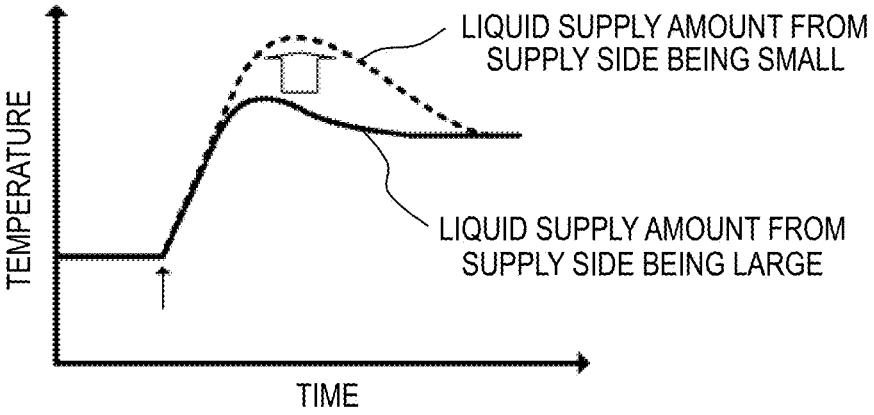
FIG. 20 is a graph showing the relationship between the time after the initiation of liquid ejection and the temperature of the liquid ejection head.

Next, a second embodiment of the present disclosure will be described with reference to FIGS. 18A to 20. FIGS. 18A and 19A are cross-sectional views schematically showing a liquid ejection head 3 having a flow path including a pressure chamber 23, an ejection orifice 13, and an energy generating element 15. FIGS. 18B to 18D and 19B to 19D are sectional views taken along the line A-A in FIGS. 18A and 19A. FIGS. 18B and 19B are schematic views showing a state in which a liquid is not ejected, FIGS. 18C and 19C are schematic views showing a state in which a liquid is ejected, and FIGS. 18D and 19D are schematic views showing the flow resistance and pressure of the flow path of each liquid ejection head 3. FIG. 20 is a graph showing the relationship between the time after the initiation of liquid ejection and the temperature of the liquid ejection head 3.

In the first embodiment shown in FIGS. 16A to 16D, the flow resistance $R_{In}$ of the flow path at the supply side increases, thereby suppressing the supply amount of the liquid at the supply side to the vicinity of the ejection orifice 13 at the time of liquid ejection. Further, as shown in FIGS. 18A to 18D, when the flow resistance $R_{In}$ of the flow path at the supply side increases, there occurs a reversal phenomenon in which the supply amount of liquid from the collection side is larger than the supply amount of liquid from the supply side at the time of liquid ejection although the pressure $P_{In}$ of the supply side is larger than the pressure $P_{Out}$ of the collection side. For example, the temperature of the liquid ejection head 3 at the time of liquid ejection is higher when the liquid supply amount at the supply side indicated by the dashed line shown in FIG. 20 is large, compared to when the liquid supply amount at the supply side indicated by the solid line in FIG. 20 is small. Therefore, as described above, the effect of the present disclosure that the amount of heat and the amount of electric power required for temperature adjustment for lowering the viscosity of the liquid is suppressed to be small can be exhibited. However, since the liquid ejected from the ejection orifice 13 has high temperature, an ejection speed increases and an ejection amount increases. In the case where an image is formed by liquid ejection, the density of the formed image becomes dense, and there is a possibility of leading to image unevenness. Therefore, particularly when an image is formed by liquid ejection, it is more preferable to properly balance the supply amount of the low-temperature liquid from the supply side and the supply amount of the high-temperature liquid from the collection side at the time of liquid ejection.

Therefore, in the present embodiment, the supply amount of the low-temperature liquid from the supply side is substantially equal to the supply amount of the high-temperature liquid from the collection side at the time of liquid ejection. Here, the capillary force of a portion of the ejection orifice 13 after the initiation of liquid ejection is represented by $P_{Noz}$, the differential pressure between this capillary force $P_{Noz}$ and the supply side pressure $P_{In}$ is represented by $\Delta P_{in}$, and the differential pressure between this capillary force $P_{Noz}$ and the collection side pressure $P_{Out}$ is represented by $\Delta P_{out}$. In the case of $(\Delta P_{in}/R_{In})=(\Delta P_{Out}/R_{Out})$, that is, $(\Delta P_{in}/R_{In})/(\Delta P_{Out}/R_{Out})=1.0$, the supply amount of the low-temperature liquid from the supply side is equal to the supply amount of the high-temperature liquid from the collection side at the time of liquid ejection, so that this case is most preferable. When $(\Delta P_{in}/R_{In})/(\Delta P_{Out}/R_{Out})$ is 0.8 to 1.2, there is somewhat an effect on suppression of image unevenness. That is, preferably, a relationship of $0.8 \leq (\Delta P_{in}/R_{In})/(\Delta P_{Out}/R_{Out}) \leq 1.2$ is satisfied, and more preferably, a relationship of $(\Delta P_{in}/R_{In})/(\Delta P_{Out}/R_{out})=1.0$ is satisfied. Thus, it is possible to suppress the change in the density of the image formed at the initiation of liquid ejection while suppressing the amount of heat and the amount of electric power required for temperature adjustment for lowering the viscosity of the liquid to be small. However, the liquid ejection head of the present disclosure is not limited to image formation, and the aforementioned relationship of $(\Delta P_{in}/R_{In})$ and $(\Delta P_{Out}/R_{Out})$ is not indispensable.

Third Embodiment

Figure 21A:
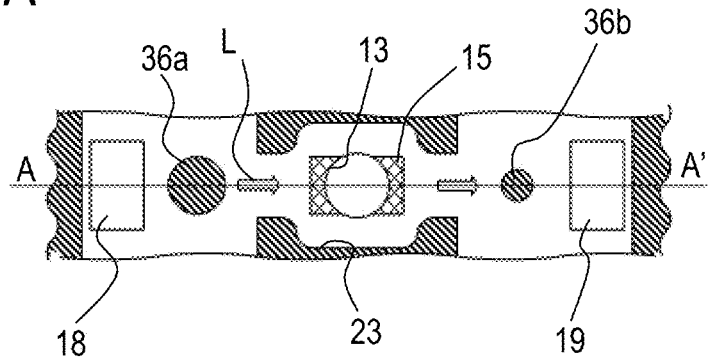
FIGS. 21A, 21B, 21C and 21D are cross-sectional views and longitudinal sectional views of a liquid ejection head according to a third embodiment of the present disclosure.
Figure 21B:
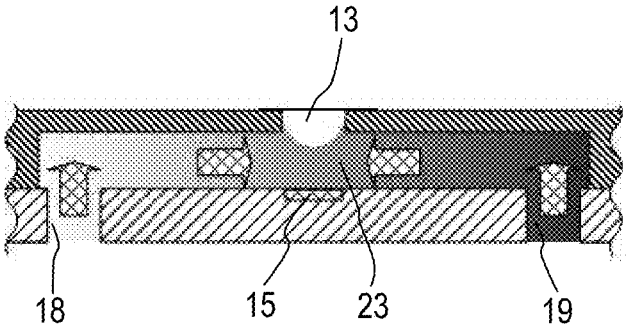
Figure 21C:
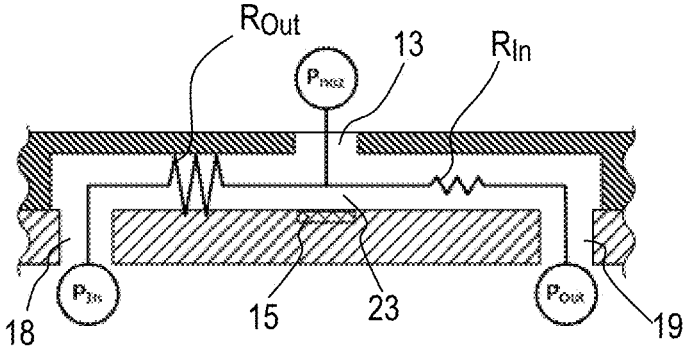
Figure 21D:
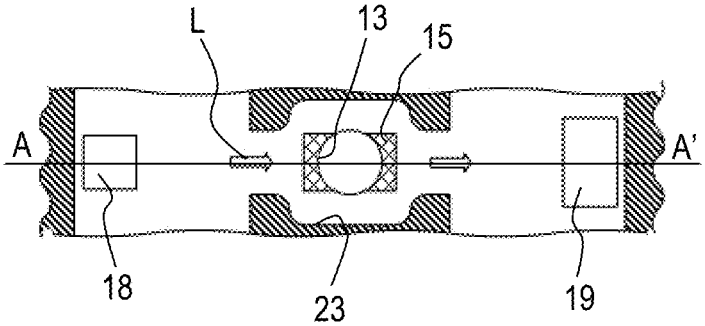

Next, a third embodiment of the present disclosure will be described with reference to FIGS. 21A to 21D. FIGS. 21A and 21D are cross-sectional views schematically showing a liquid ejection head 3 having a flow path including a pressure chamber 23, an ejection orifice 13, and an energy generating element 15. FIG. 21B is a sectional view taken along the line A-A in FIG. 21A, and is a schematic view showing a state in which a liquid is ejected from a state in which a circulation flow L is generated. FIG. 21C is a schematic view showing the flow resistance and pressure of the flow path of the liquid ejection head 3 shown in FIGS. 21A and 21B.

In the configuration shown in FIG. 21A, the size of a nozzle filter 36*a* formed inside the flow path at the supply side is different from the size of a nozzle filter 36*b* formed inside the flow path at the collection side. Here, the flow path at the supply side refers to a generic term including a liquid supply path 18 and a flow path from the liquid supply path 18 to the ejection orifice 13, and the flow path at the collection side refers to a generic term including a liquid collecting path 19 and a flow path from the liquid collecting path 19 to the ejection orifice 13. Due to the difference in size between the nozzle filter 36*a* and the nozzle filter 36*b*, a relationship of flow resistance $R_{In}>R_{Out}$ is satisfied. Further, in the configuration shown in FIG. 21D, the size of the supply port 17*a* (refer to FIG. 11) which is a part of the liquid supply path 18 is different from the size of the collection port 17*b* (refer to FIG. 11) which is a part of the liquid collecting path 19, and thus a relationship of flow resistance $R_{In}>R_{Out}$ is satisfied. As described above, in the present embodiment, the flow resistances Rut and $R_{Out}$ are made different from each other without changing the shape of the flow path itself. In the configuration shown in FIG. 21A, since a relationship of flow resistance $R_{In}>R_{Out}$ is satisfied, as shown in FIG. 21C, the amount of the low-temperature liquid supplied from the supply side can be suppressed to the same level as the high-temperature liquid supplied from the collection side. Therefore, the amount of heat and the amount of electric power required for temperature adjustment for lowering the viscosity of the liquid in the vicinity of the ejection orifice 13 can be suppressed to be small at the time of liquid ejection. Further, since the flow path shapes at both sides of the pressure chamber are substantially equal to each other, bubbles generated at the time of liquid ejection are less likely to become asymmetric, and occurrence of deflection of ejected droplets is suppressed. These effects can be similarly obtained in the configuration shown FIG. 21D.

According to the present disclosure, it is possible to reduce electric power required for temperature adjustment of a liquid circulated through the liquid ejection head and ejected to the outside.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-134030, filed Jul. 7, 2017, which is hereby incorporated by reference herein in its entirety.

What is claimed is:

1. A liquid ejection head, comprising:

a recording element substrate including an ejection orifice for ejecting liquid, a pressure chamber provided with an energy generating element for generating energy used to eject liquid, a liquid supply path for supplying liquid to the pressure chamber, and a liquid collecting path for collecting liquid from the pressure chamber, wherein the liquid supply path, the pressure chamber, and the liquid collecting path of the recording element substrate constitute a part of a circulation path in which liquid flows in the order as listed, a flow resistance $R_{In}$ of a flow path including the liquid supply path at a supply side is greater than a flow resistance $R_{Out}$ of a flow path including the liquid collecting path at a collection side, and wherein, when a capillary force of a portion of the ejection orifice at the time of liquid ejection is represented by $P_{Noz}$, a pressure of the flow path at the supply side is represented by $P_{In}$, a differential pressure between the capillary force $P_{Noz}$ and the pressure of the flow path at the supply side $P_{In}$ is represented by $\Delta P_{in}$, a pressure of the flow path at the collection side is represented by $P_{Out}$, and a differential pressure between the capillary force $P_{Noz}$ and the pressure of the flow path at the collection side $P_{Out}$ is represented by $\Delta P_{Out}$, a relationship of $0.8 \leq (\Delta P_{In}/R_{In})/(\Delta P_{Out}/R_{Out}) \leq 1.2$ is satisfied.

2. The liquid ejection head according to claim 1, wherein the flow resistance $R_{In}$ of the flow path at the supply side is a flow resistance of a flow path combining the liquid supply path with a flow path from the liquid supply path to the ejection orifice, and the flow resistance $R_{Out}$ of the flow path at the collection side is a flow resistance of a flow path combining a flow path from the ejection orifice to the liquid collecting path with the liquid collecting path.

3. The liquid ejection head according to claim 1, wherein the relationship of $(\Delta P_{In}/R_{In})/(\Delta P_{Out}/R_{Out})=1.0$ is satisfied.

4. The liquid ejection head according to claim 1, wherein at least a part of the flow path at the supply side has a shorter width than the flow path at the collection side.

5. The liquid ejection head according to claim 1, wherein the flow path at the supply side has a longer length than the flow path at the collection side.

6. The liquid ejection head according to claim 1, wherein at least a part of the flow path at the supply side has a shorter height than the flow path at the collection side.

7. The liquid ejection head according to claim 1, wherein the flow path at the supply side is provided with a nozzle filter larger than a nozzle filter provided in the flow path at the collection side.

8. The liquid ejection head according to claim 1, wherein the liquid supply path has a supply port smaller than a collection port of the liquid collecting path.

9. The liquid ejection head according to claim 1, wherein the liquid circulating through the pressure chamber has a flow speed 0.1 to 100 mm/s.

10. The liquid ejection head according to claim 1, wherein the liquid ejection head is a page-wide liquid ejection head in which a plurality of recording element substrates are linearly arranged.

11. The liquid ejection head according to claim 1, wherein the liquid in the pressure chamber is circulated between the pressure chamber and outside of the pressure chamber.

12. A liquid ejection apparatus, comprising:

the liquid ejection head according to claim 1; and a conveyance unit supporting and conveying a recording medium at a position facing the liquid ejection head.

13. A liquid supply method, in which a liquid ejection head having a recording element substrate including an ejection orifice for ejecting liquid, a pressure chamber provided with an energy generating element for generating energy used to eject liquid, a liquid supply path for supplying liquid to the pressure chamber, and a liquid collecting path for collecting liquid from the pressure chamber is used, the method comprising:

generating a circulation flow in which liquid flows through the liquid supply path, the pressure chamber, and the liquid collecting path of the recording element substrate in the order as listed when liquid is not ejected; and flowing the liquid from both the liquid supply path and the liquid collecting path into the pressure chamber when the liquid is ejected, wherein a flow resistance $R_{In}$ of a flow path including the liquid supply path at a supply side is greater than a flow resistance $R_{Out}$ of a flow path including the liquid collecting path at a collection side, and wherein, when a capillary force of a portion of the ejection orifice at the time of liquid ejection is represented by $P_{Noz}$, a pressure of the flow path at the supply side is represented by $P_{In}$, a differential pressure between the capillary force $P_{Noz}$ and the pressure of the flow path at the supply side $P_{In}$ is represented by $\Delta P_{In}$, a pressure of the flow path at the collection side is represented by $P_{Out}$, and a differential pressure between the capillary force $P_{Noz}$ and the pressure of the flow path at the collection side $P_{Out}$ is represented by $\Delta P_{Out}$, a relationship of $0.8 \leq (\Delta P_{In}/R_{In})/(\Delta P_{Out}/R_{out}) \leq 1.2$ is satisfied.

14. The liquid supply method according to claim 13, wherein the flow resistance $R_{In}$ of the flow path at the supply side is a flow resistance of a flow path combining the liquid supply path with a flow path from the liquid supply path to the ejection orifice, and the flow resistance $R_{Out}$ of the flow path at the collection side is a flow resistance of a flow path combining a flow path from the ejection orifice to the liquid collecting path with the liquid collecting path.

15. The liquid supply method according to claim 14, wherein pressure in the liquid supply path is higher than pressure in the liquid collecting path.

16. The liquid supply method according to claim 14, wherein an amount of the liquid supplied from the liquid supply path to the pressure chamber is equal to an amount of the liquid supplied from the liquid collecting path to the pressure chamber.

* * * * *